US012225961B2

(12) United States Patent
Farina et al.

(10) Patent No.: US 12,225,961 B2
(45) Date of Patent: Feb. 18, 2025

(54) SOLE STRUCTURE FOR ARTICLE OF FOOTWEAR AND ARTICLE OF FOOTWEAR

(71) Applicant: NIKE, Inc., Beaverton, OR (US)

(72) Inventors: Emily Farina, Beaverton, OR (US); Adam Kiss, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 124 days.

(21) Appl. No.: 17/905,915

(22) PCT Filed: Mar. 24, 2021

(86) PCT No.: PCT/US2021/023890
§ 371 (c)(1),
(2) Date: Sep. 8, 2022

(87) PCT Pub. No.: WO2021/195213
PCT Pub. Date: Sep. 30, 2021

(65) Prior Publication Data

US 2023/0124653 A1 Apr. 20, 2023

Related U.S. Application Data

(60) Provisional application No. 62/994,578, filed on Mar. 25, 2020.

(51) Int. Cl.
*A43B 13/12* (2006.01)

(52) U.S. Cl.
CPC ..... *A43B 13/125* (2013.01)

(58) Field of Classification Search
CPC ..... A43B 13/026; A43B 13/125; A43B 13/10; A43B 13/22; A43B 13/222
(Continued)

(56) References Cited

U.S. PATENT DOCUMENTS 2,239,471 A 4/1941 Srajer
5,218,773 A * 6/1993 Beekman ..... A43B 7/14 36/68
(Continued)

FOREIGN PATENT DOCUMENTS

CN 106821684 A 6/2017
CN 107259705 A 10/2017
(Continued)

OTHER PUBLICATIONS

European Patent Office (ISA), International Search Report and Written Opinion of the International Searching Authority for PCT/US2021/023890 mailed Jun. 29, 2021.
(Continued)

*Primary Examiner* — Ted Kavanaugh
(74) *Attorney, Agent, or Firm* — Honigman LLP; Matthew H. Szalach; Jonathan P. O'Brien

(57) ABSTRACT

A sole structure for an article of footwear having an upper. The sole structure includes an outsole having a ground-engaging surface and an upper surface formed on an opposite side of the outsole than the ground-engaging surface. The sole structure also includes a midsole attached to the outsole and including an outer perimeter surface extending between the outsole and the upper. The sole structure further includes a plate disposed at least partially within the midsole and extending (i) from a forefoot region of the sole structure, (ii) through a metatarsophalangeal (MTP) point of the sole structure, and (iii) toward a heel region of the sole structure. The plate includes a first plate portion extending from the outer perimeter surface of the midsole.

20 Claims, 21 Drawing Sheets

(58) Field of Classification Search
USPC ..... 36/68, 69, 30 R
See application file for complete search history.

(56) References Cited

U.S. PATENT DOCUMENTS

| | | | | |
|---|---|---|---|---|
| 7,421,805 | B2 * | 9/2008 | Geer | A43B 3/0057 36/31 |
| 8,635,785 | B2 * | 1/2014 | Seo | A43B 13/127 36/27 |
| 8,978,272 | B2 * | 3/2015 | Hurd | A43B 7/14 36/27 |
| 9,167,868 | B1 * | 10/2015 | Koo | A43B 13/12 |
| 10,111,492 | B2 * | 10/2018 | Foxen | A43B 13/187 |
| 2010/0146817 | A1 | 6/2010 | Crispo | |
| 2012/0079747 | A1 | 4/2012 | Seo | |
| 2019/0298599 | A1 | 10/2019 | Mooney et al. | |

FOREIGN PATENT DOCUMENTS

| | | | |
|---|---|---|---|
| CN | 108785011 | A | 11/2018 |
| DE | 1881914 | U | 10/1963 |
| EP | 3485809 | A1 | 5/2019 |

OTHER PUBLICATIONS

The State Intellectual Property Office of PRC, Office Action for CN App. No. 202180024521.9, mailed Aug. 14, 2024.

* cited by examiner

FIG. 18
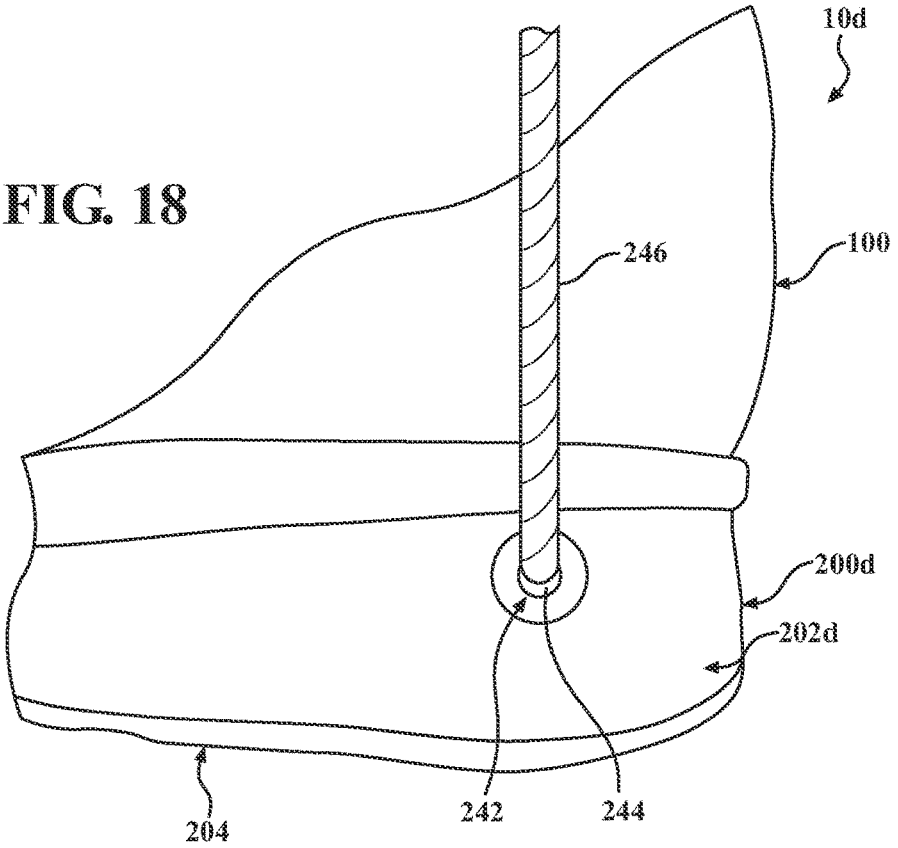
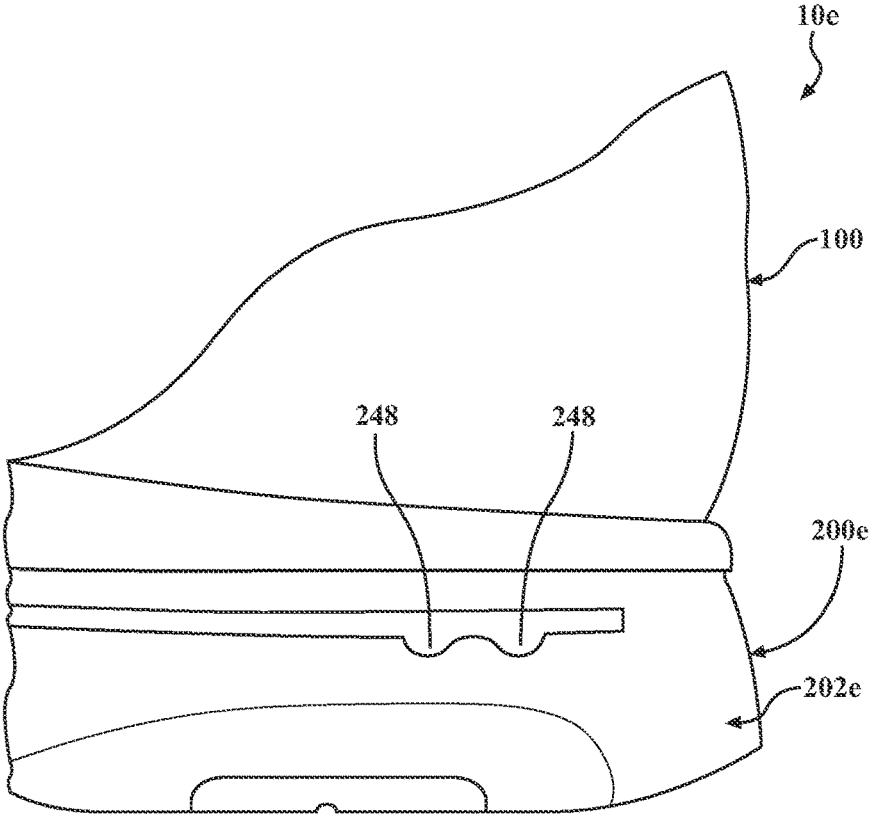
FIG. 19

SOLE STRUCTURE FOR ARTICLE OF FOOTWEAR AND ARTICLE OF FOOTWEAR

CROSS REFERENCE TO RELATED APPLICATIONS

The present application is a national stage application under 35 U.S.C. § 371 of International Application No. PCT/US2021/023890, entitled SOLE STRUCTURE FOR ARTICLE OF FOOTWEAR AND ARTICLE OF FOOTWEAR, filed on Mar. 24, 2021, which claims priority under 35 U.S.C. § 119 (e) to U.S. Provisional Application Ser. No. 62/994,578, filed Mar. 25, 2020, the content of which is hereby incorporated by reference in its entirety.

FIELD

The present disclosure relates to a sole structure for an article of footwear and more particularly to a sole structure for an article of footwear that allows the sole structure to be selectively attached to an external structure such as, for example, an exoskeleton.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and is generally at least partially formed from a polymer foam material that compresses resiliently under an applied load to cushion the foot by attenuating ground-reaction forces. The midsole may define a bottom surface on one side that opposes the outsole and a footbed on the opposite side that may be contoured to conform to a profile of the bottom surface of the foot. Sole structures may also include a comfort-enhancing insole or a sockliner located within a void proximate to the bottom portion of the upper.

Exoskeletons may be used in conjunction with conventional articles of footwear during running movements to improve running performance by reducing the energetic costs associated with running. Such exoskeletons, while improving running performance, are often difficult to attach to conventional articles of footwear, as conventional articles of footwear are not designed for use with such external systems. For example, conventional articles of footwear are often retrofitted to accommodate an exoskeleton by providing the article of footwear with external structure such as tape, adhesives, and the like. While such retrofitted articles of footwear may be adequately attached to an exoskeleton, it is difficult to maintain a relative position between the exoskeleton and the article of footwear over long periods of use. Further, a repeatable attachment of the exoskeleton to the article of footwear is difficult to achieve due to the generally cobbled means by which the exoskeleton is attached to the retrofitted article of footwear.

DRAWINGS

The drawings described herein are for illustrative purposes only of selected configurations and are not intended to limit the scope of the present disclosure.

FIG. 18 is a partial perspective view of a heel portion of a sole structure in accordance with the principles of the present disclosure;

FIG. 19 is a partial perspective view of a heel portion of a sole structure in accordance with the principles of the present disclosure;

Corresponding reference numerals indicate corresponding parts throughout the drawings.

DETAILED DESCRIPTION

Figure 1:
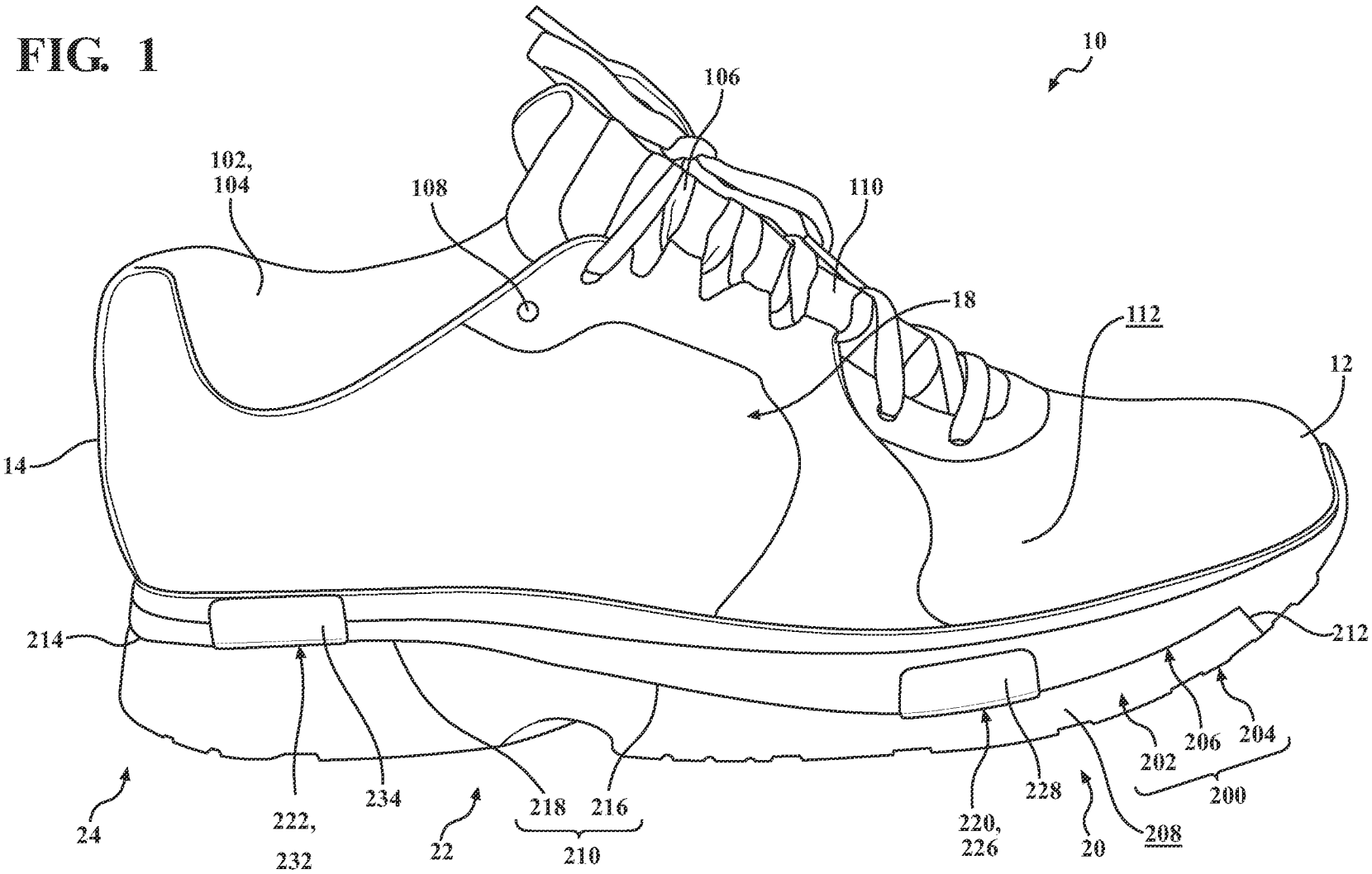
FIG. 1 is a lateral side view of an article of footwear in accordance with the principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides a sole structure for an article of footwear having an upper. The sole structure includes an outsole having a ground-engaging surface and an upper surface formed on an opposite side of the outsole than the ground-engaging surface. The sole structure also includes a midsole attached to the outsole and including an outer perimeter surface extending between the outsole and the upper. The sole structure further includes a plate disposed at least partially within the midsole and extending (i) from a forefoot region of the sole structure, (ii) through a metatarsophalangeal (MTP) point of the sole structure, and (iii) toward a heel region of the sole structure. The plate includes a first plate portion extending from the outer perimeter surface of the midsole.

Implementations of the disclosure may include one or more of the following optional features. In some implementations, the first plate portion extends from the outer perimeter surface at one of a medial side of the sole structure and a lateral side of the sole structure. Here, the plate may include a second plate portion extending from the outer perimeter surface of the midsole. The second plate portion may be disposed on an opposite side of the plate than the first plate portion. Optionally, the second plate portion may be disposed at the other of the medial side and the lateral side. The first plate portion and the second plate portion may be aligned with the MTP point. The second plate portion may be diametrically opposed to the first plate portion.

In some examples, the first plate portion extends from a heel region of the sole structure. The plate may extend from an anterior end of the sole structure to a posterior end of the sole structure. The plate may include a first plate segment disposed in a forefoot region of the sole structure and a second plate segment disposed in a heel region of the sole structure, the first plate segment may be spaced apart from the second plate segment.

In some configurations, the sole structure includes a bore extending through the midsole from a medial side of the sole structure to a lateral side of the sole structure. Here, the bore may be disposed at a heel region of the sole structure. The first plate portion may include at least one of a flange, an aperture, and a slot operable to selectively attach the first plate portion to an external structure.

In some implementations, the midsole includes a first midsole portion disposed between the plate and the upper and a second midsole portion disposed between the plate and the outsole. The first midsole portion may increase in thickness in a direction extending from a heel region of the sole structure toward a forefoot region of the sole structure. A thickness of the first midsole portion may be greatest at the MTP point. Optionally, the second midsole portion may increase in thickness in a direction extending from a forefoot region of the sole structure toward a heel region of the sole structure.

In some examples, the first plate portion includes a main body extending from the outer perimeter surface of the midsole and a flange extending from the main body in a direction away from the outsole. Here, the flange may extend substantially perpendicular to the main body of the first plate portion. An article of footwear may include the sole structure.

Another aspect of the disclosure provides a sole structure for an article of footwear having an upper. The sole structure includes an outsole having a ground-engaging surface and an upper surface formed on an opposite side of the outsole than the ground-engaging surface. The sole structure also includes a midsole attached to the outsole and including an outer perimeter surface extending between the outsole and the upper. The sole structure further includes a plate disposed at least partially within the midsole and extending (i) from a forefoot region of the sole structure, (ii) through a metatarsophalangeal (MTP) point of the sole structure, and (iii) toward a heel region of the sole structure. The plate includes a first plate portion defining a first hinge portion of a first hinge and a second plate portion defining a second hinge portion of a second hinge.

This aspect may include one or more of the following optional features. In some configurations, the first plate portion extends from the outer perimeter surface at one of a medial side of the sole structure and a lateral side of the sole structure. The second plate portion may extend from the outer perimeter surface at the other of the medial side of the sole structure and the lateral side of the sole structure. The second plate portion may be disposed on an opposite side of the plate than the first plate portion. Additionally or alternatively, the second plate portion may be disposed at the other of the medial side and the lateral side.

In some implementations, the first plate portion and the second plate portion are aligned with the MTP point. The second plate portion may be diametrically opposed to the first plate portion. The first plate portion and the second plate portion may extend along a longitudinal axis passing through the plate at a localized area of increased rigidity of the plate. The plate may extend from an anterior end of the sole structure to a posterior end of the sole structure. The plate may include a first plate segment disposed in a forefoot region of the sole structure and a second plate segment disposed in a heel region of the sole structure, the first plate segment may be spaced apart from the second plate segment.

In some examples, the sole structure includes a bore extending through the midsole from a medial side of the sole structure to a lateral side of the sole structure. The bore may be disposed at a heel region of the sole structure. The first hinge portion and the second hinge portion may each include at least one of a flange, an aperture, and a slot operable to selectively attach the first plate portion and the second plate portion to an external structure.

In some configurations, the midsole includes a first midsole portion disposed between the plate and the upper and a second midsole portion disposed between the plate and the outsole. The first midsole portion may increase in thickness in a direction extending from a heel region of the sole structure toward a forefoot region of the sole structure. A thickness of the first midsole portion may be greatest at the MTP point. The second midsole portion may increase in thickness in a direction extending from a forefoot region of the sole structure toward a heel region of the sole structure.

In some implementations, the first plate portion includes a first main body extending from the outer perimeter surface of the midsole and the first hinge portion includes a first flange extending from the first main body in a direction away from the outsole. In this implementation, the second plate portion includes a second main body extending from the outer perimeter surface of the midsole and the second hinge portion includes a second flange extending from the second main body in a direction away from the outsole. Here, the first flange may extend substantially perpendicular to the first main body of the first plate portion and the second flange may extend substantially perpendicular to the second main body of the second plate portion. An article of footwear may incorporate the sole structure.

The details of one or more implementations of the disclosure are set forth in the accompanying drawings and the description below. Other aspects, features, and advantages will be apparent from the description and drawings, and from the claims.

Figure 2:
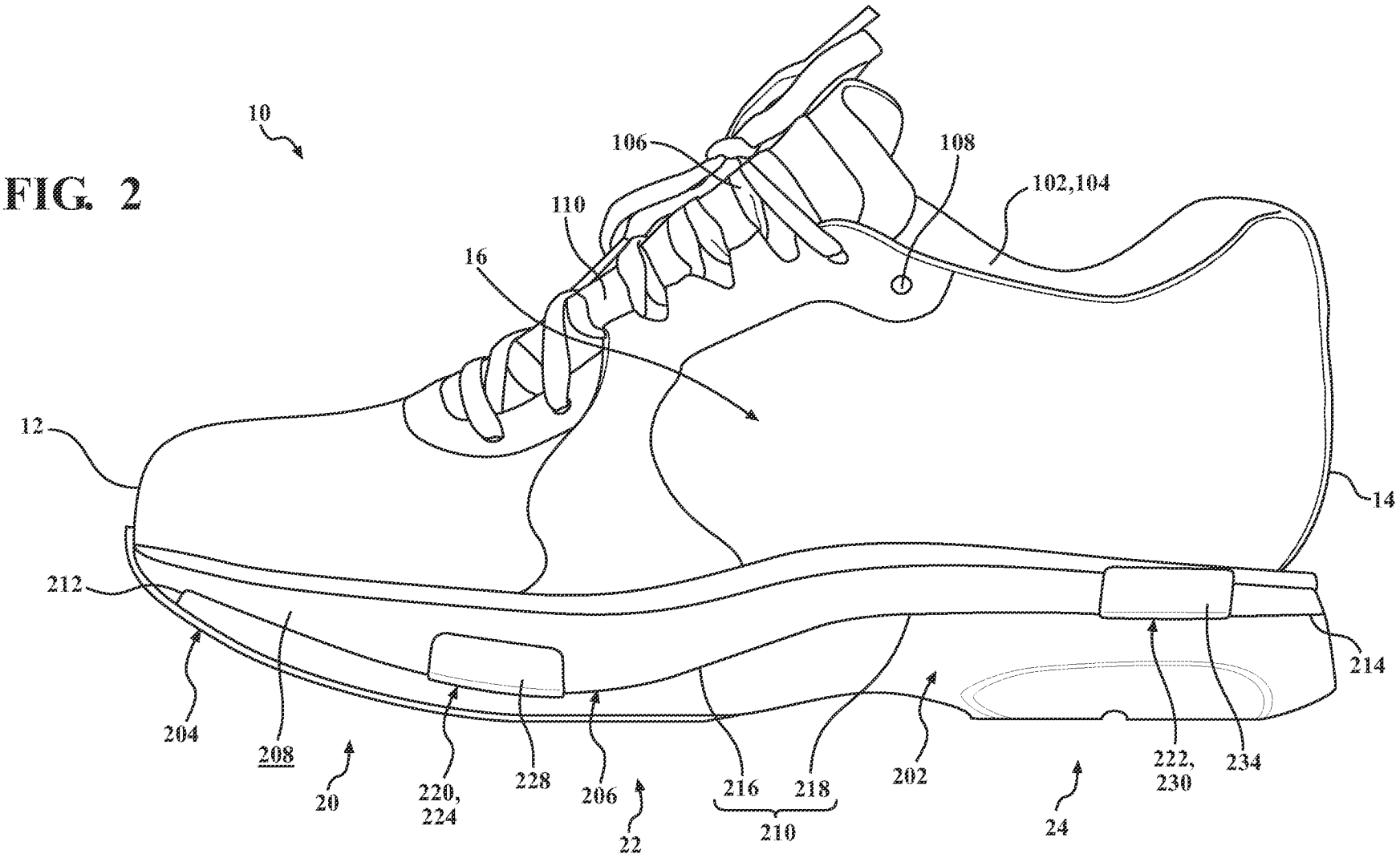
FIG. 2 is a medial side view of the article of footwear of FIG. 1.
Figure 3:
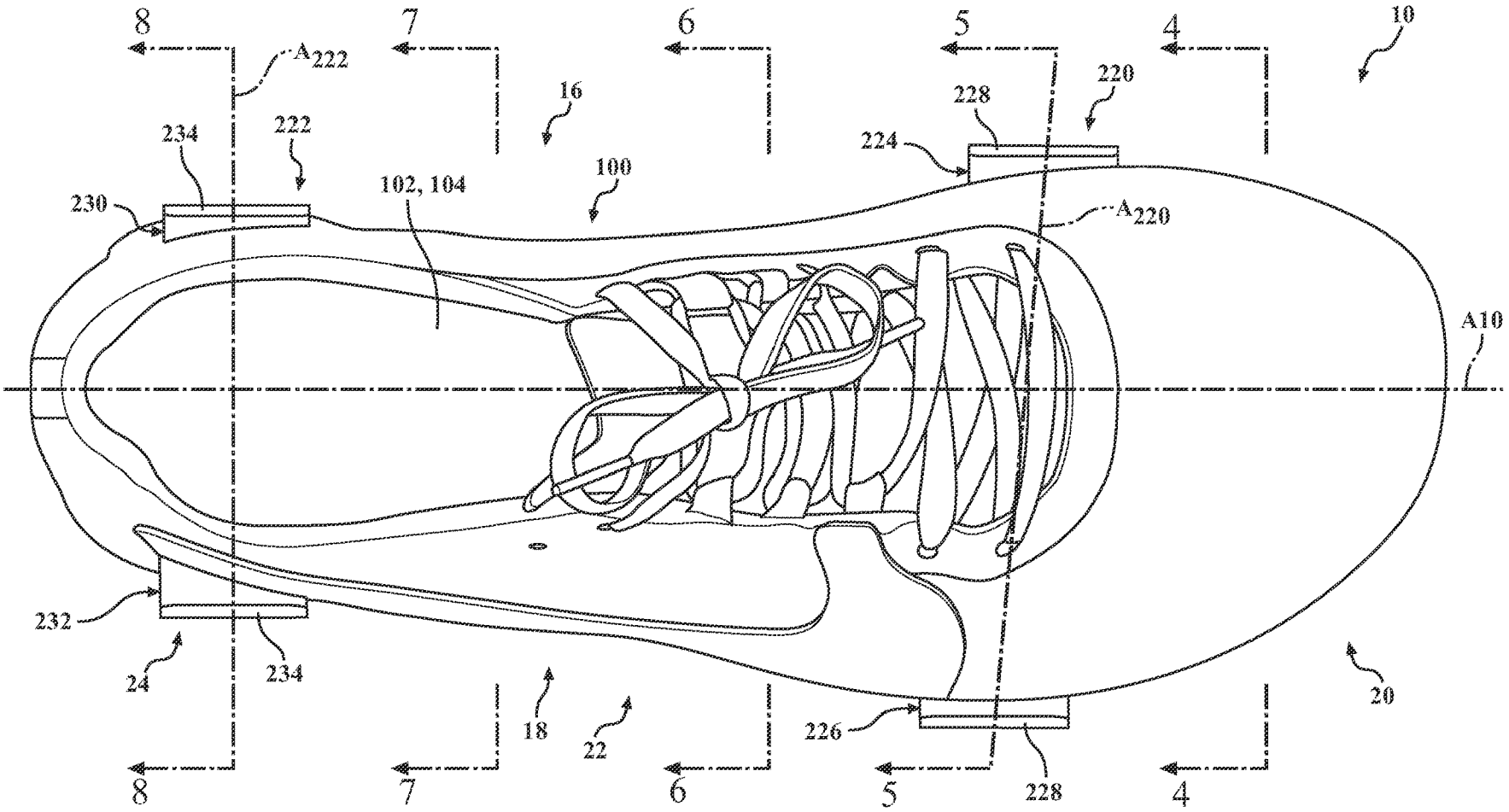
FIG. 3 is a top view of the article of footwear of FIG. 1.
Figure 4:
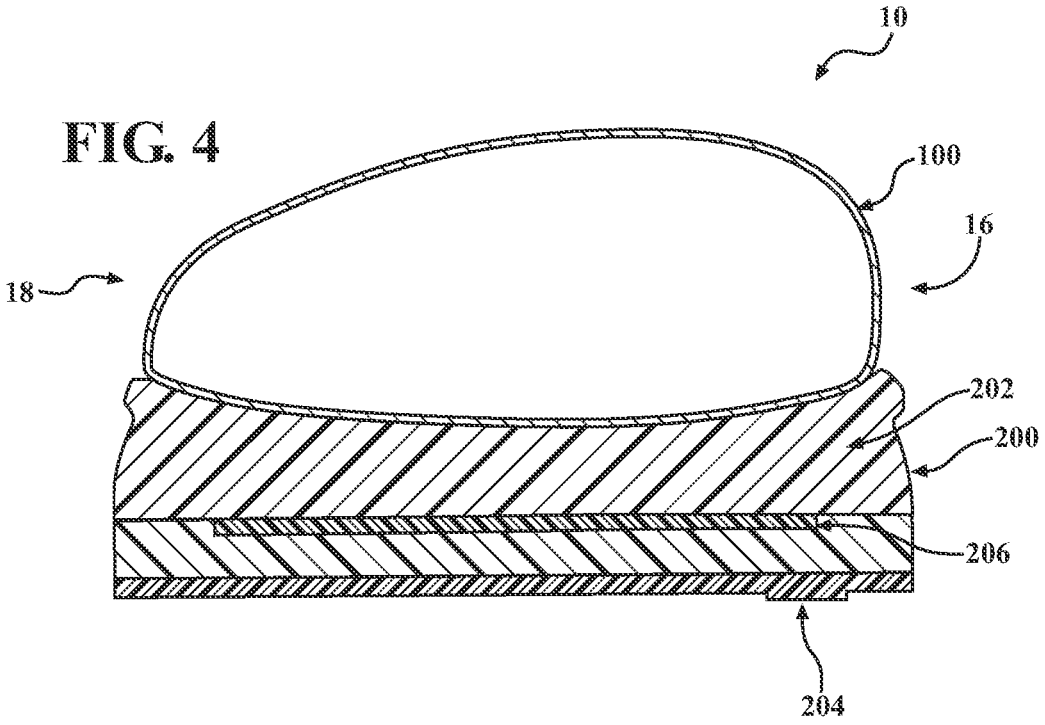
FIG. 4 is a cross-sectional view of the article of footwear of FIG. 1, taken along Line 4-4 in FIG. 3.

With reference to FIGS. 1-8, an article of footwear 10 is provided and includes an upper 100 and a sole structure 200 attached to the upper 100. The footwear 10 may further include an anterior end 12 associated with a forward-most point of the footwear 10, and a posterior end 14 corresponding to a rearward-most point of the footwear 10. As shown in FIG. 4, a longitudinal axis $A_{10}$ of the footwear 10 extends along a length of the footwear 10 from the anterior end 12 to the posterior end 14 parallel to a ground surface, and generally divides the footwear 10 into a medial side 16 and a lateral side 18. Accordingly, the medial side 16 and the lateral side 18 respectively correspond with opposite sides of the footwear 10 and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the medial side 16 to the lateral side 18.

The article of footwear 10 may be divided into one or more regions. The regions may include a forefoot region 20, a mid-foot region 22, and a heel region 24. The forefoot region 20 may be subdivided into a toe portion corresponding with phalanges and a ball portion associated with metatarsal bones of a foot. A metatarsophalangeal (MTP) point of the sole structure 200 is aligned with an MTP joint of the foot within the ball portion. The mid-foot region 22 may correspond with an arch area of the foot, and the heel region 24 may correspond with rear portions of the foot, including a calcaneus bone.

The upper 100 includes interior surfaces that define an interior void 102 that receives and secures a foot for support on the sole structure 200. An ankle opening 104 in the heel region 24 may provide access to the interior void 102. For example, the ankle opening 104 may receive a foot to secure the foot within the void 102 and facilitate entry and removal of the foot from and to the interior void 102. In some examples, one or more fasteners 106 extend along the upper 100 to adjust a fit of the interior void 102 around the foot while concurrently accommodating entry and removal of the foot therefrom. The upper 100 may include apertures 108 such as eyelets and/or other engagement features such as fabric or mesh loops that receive the fasteners 106. The fasteners 106 may include laces, straps, cords, hook-and-loop, or any other suitable type of fastener.

The upper 100 may additionally include a tongue portion 110 that extends between the interior void 102 and the fasteners 106. The upper 100 may be formed from one or more materials that are stitched or adhesively bonded together to form the interior void 102. Suitable materials of the upper 100 may include, textiles, foam, leather, and synthetic leather. The materials may be selected and located to impart properties of durability, air-permeability, wear-resistance, flexibility, and comfort to the foot while disposed within the interior void 102.

The sole structure 200 is attached to the upper 100 and provides the article of footwear 10 with support and cushioning during use. Namely, the sole structure 200 attenuates ground-reaction forces caused by the article of footwear 10 striking the ground during use. Accordingly, and as set forth below, the sole structure 200 may incorporate one or more materials having energy absorbing characteristics to allow the sole structure 200 to minimize the impact experienced by a user when wearing the article of footwear 10.

The sole structure 200 may include a midsole 202, an outsole 204, and a plate 206 that extends from the anterior end 12 of the article of footwear 10 towards the posterior end 14.

With continued reference to FIGS. 1-8, the midsole 202 is shown as extending from the anterior end 12 of the article of footwear 10 to the posterior end 14. The midsole 202 may include a material such as, for example, polymer foam. In one configuration, the midsole 202 opposes a strobel (not shown) of the upper 100 and may extend at least partially onto an upper surface 112 of the upper 100 (FIG. 1) such that the midsole 202 covers a junction of the upper 100 and the strobel. The midsole 202 may include an upper midsole portion 203*a* and a lower midsole portion 203*b*. As shown, the plate 206 is disposed between the upper midsole portion 203*a* and the lower midsole portion 203*b*.

Forming the midsole 202 from a compliant, yet resilient material such as polymer foam allows the midsole 202 to attenuate ground-reaction forces caused by movement of the article of footwear 10 over ground during use. In addition to attenuating forces associated with use of the article of footwear 10, the midsole 202 may serve to attach the plate 206 to the upper 100. A suitable adhesive (not shown) may be used to attach the midsole 202 and the strobel. Alternatively, the plate 206 may be attached to the midsole 202 by molding a material of the midsole 202 directly to the plate 206. For example, the plate 206 may be disposed within a cavity of a mold (not shown) used to form the midsole 202. Accordingly, when the midsole 202 is formed (i.e., by foaming a polymer material), the material of the midsole 202 is joined to the material of the plate 206, thereby forming a unitary structure having both the midsole 202 and the plate 206. Once formed, the midsole 202—including the plate 206—can be attached to the strobel and/or the upper 100. In some examples, the upper midsole portion 203*a* and the lower midsole portion 203*b* may be formed as separate components and/or of different materials and attached to opposite sides of the plate 206.

As described above, the midsole 202 includes a resilient polymeric material, such as foam or rubber, to impart properties of cushioning, responsiveness, and energy distribution to the foot of the wearer. Example resilient polymeric materials for the midsole 202 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., crosslinked polyurethanes and/or thermoplastic polyurethanes). Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as azodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a crosslinking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

The plate 206 could be embedded within the material of the midsole 202 such that the plate 206 may be encapsulated by the midsole 202. Further yet, the plate 206 could be disposed within the midsole 202 but not be fully encapsulated.

Regardless of the particular location of the plate 206 relative to the midsole 202, the plate 206 may be formed from a relatively rigid material. For example, the plate 206 may be formed from a non-foamed polymer material or, alternatively, from a composite material containing fibers such as carbon fibers. Forming the plate 206 from a relatively rigid material allows the plate 206 to distribute forces associated with use of the article footwear 10 when the article of footwear 10 is in contact with a ground surface, as will be described in greater detail below.

In some examples, the plate 206 includes a uniform local stiffness (e.g., tensile strength or flexural strength) throughout the entire surface area of the plate 206. The stiffness of the plate 206 may be anisotropic where the stiffness in one direction across the plate 206 is different from the stiffness in another direction. For instance, the plate 206 may be formed from at least two layers of fibers anisotropic to one another to impart gradient stiffness and gradient load paths across the plate 206. In one configuration, the plate 206 is formed from one or more layers of tows of fibers and/or layers of fibers including at least one of carbon fibers, aramid fibers, boron fibers, glass fibers, and polymer fibers. In a particular configuration, the fibers include carbon fibers, or glass fibers, or a combination of both carbon fibers and glass fibers. The tows of fibers may be affixed to a substrate. The tows of fibers may be affixed by stitching or using an adhesive. Additionally or alternatively, the tows of fibers and/or layers of fibers may be consolidated with a thermoset polymer and/or a thermoplastic polymer. Accordingly, the plate 206 may have a tensile strength or flexural strength in a transverse direction substantially perpendicular to the longitudinal axis $A_{10}$. The stiffness of the plate 206 may be selected for a particular wearer based on the wearer's shoe size, body mass, running speed, or optimized ankle torque profile. Moreover, the stiffness of the plate 206 may also be tailored based upon a running motion of the athlete. In other configurations, the plate 206 is formed from one or more layers/plies of unidirectional tape. In some examples, each layer in the stack includes a different orientation than the layer disposed underneath. The plate 206 may be formed from unidirectional tape including at least one of carbon fibers, aramid fibers, boron fibers, glass fibers, and polymer fibers. In some examples, the one or more materials forming the plate 206 include a Young's modulus of at least 10a gigapascals (GPa).

In some implementations, the plate 206 includes a substantially uniform thickness ranging from about 0.6 millimeter (mm) to about 5.0 mm. In one example, the thickness of the plate is substantially equal to one (1.0) mm. In other implementations, the thickness of the plate 206 is non-uniform such that the plate 206 may define a greater thickness in different regions of the sole structure 200. The plate 206 may be constructed, as described in U.S. application Ser. No. 15/248,051 and U.S. application Ser. No. 15/248,059, which are hereby incorporated by reference in their entireties.

Regardless of the materials used to form the plate 206, the plate 206 may be a so-called "full-length plate" having a main body 210 (FIG. 9) that extends from a first end 212 adjacent to the anterior end 12 to a second end 214 adjacent to the posterior end 14. Allowing the plate 206 to extend from the anterior end 12 to the posterior end 14 causes the plate 206 to extend from the forefoot region 20 through the mid-foot region 22 and to the heel region 24. While the plate 206 may be a full-length plate that extends from the forefoot region 20 to the heel region 24, the plate 206 could alternatively extend through only a portion of the sole structure 200. For example, the plate 206 may extend from the anterior end 12 of the article of footwear 10 to the mid-foot region 22 without extending fully through the mid-foot region 22 and into the heel region 24.

As shown in FIGS. 1-9, the main body 210 of the plate 206 is shown as including a curved portion 216 in the forefoot region 20 and a substantially flat portion 218 in the heel region 24. The curved portion 216 defines a concavity facing in a direction toward the upper 100 in the mid-foot region 22 and extends from the first end 212 to the substantially flat portion 218 in the heel region 24. In so doing, the foam material of the midsole 202 is thickest in an area between the plate 206 and the upper 100 in the forefoot region 20 of the sole structure 200 and has a reduced thickness at the heel region 24 of the sole structure 200, between the plate 206 and the upper 100.

The shape of the plate 206 also causes the foam material of the midsole 202 (e.g., the upper midsole portion 203*a*) to be at its thinnest in an area of the forefoot region 20 of the sole structure 200 between the plate 206 and the outsole 204. Conversely, the foam material of the midsole 202 is thickest in an area beneath the plate 206 (i.e., the lower midsole portion 203*b*) in the heel region 24 of the sole structure 200. Specifically, the foam material of the midsole 202 is at its thickest beneath the plate 206 in an area between the substantially flat portion 218 of plate 206 and the outsole 204 in the heel region 24 of the sole structure 200.

The foregoing construction of the midsole 202 and the position of the plate 206 relative to and within the midsole 202 allows the plate 206 to be positioned in close proximity to a ground-contacting surface in the forefoot region 20 and to be spaced apart a greater distance from the ground-contacting surface in the heel region 24. In so doing, forces applied to the outsole 204 during walking and running movements are transmitted via the outsole 204 substantially directly to the forward portion of the plate 206 disposed in the forefoot region 20. Further, because the plate 206 is spaced apart a greater distance from the upper 100 in the forefoot region 20 of the sole structure 200, the foam material of the midsole 202 disposed between the plate 206 and the upper 100 in the forefoot region 20 provides a wearer with a degree of comfort during walking and running movements.

Figure 5:
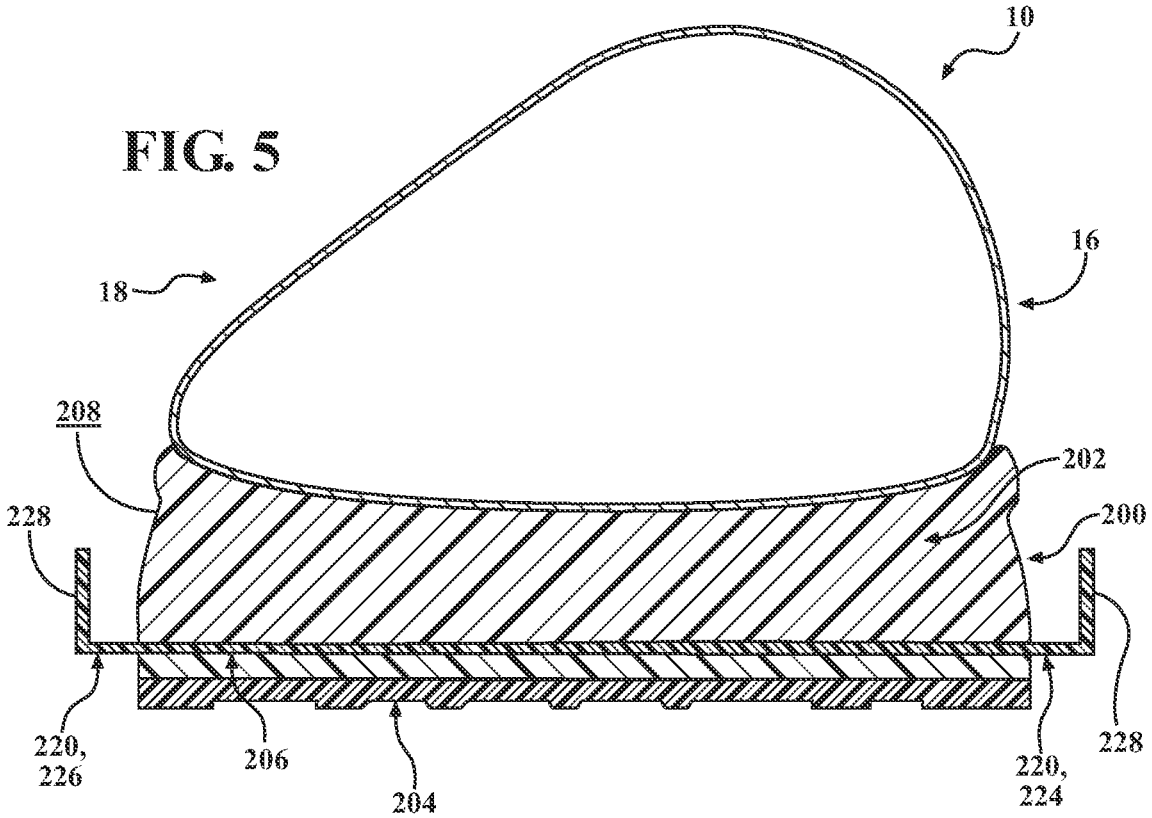
FIG. 5 is a cross-sectional view of the article of footwear of FIG. 1, taken along Line 5-5 in FIG. 3.
Figure 6:
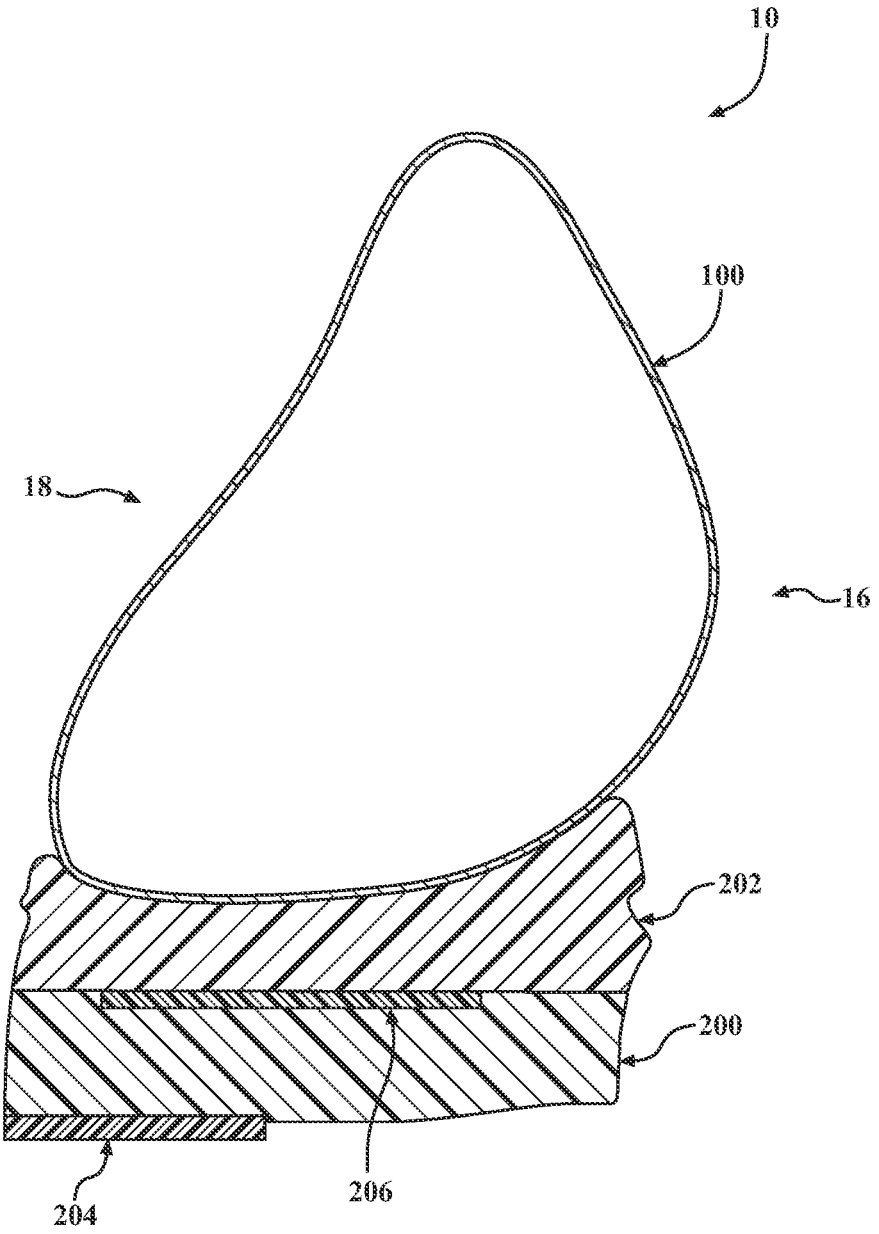
FIG. 6 is a cross-sectional view of the article of footwear of FIG. 1, taken along Line 6-6 in FIG. 3.
Figure 7:
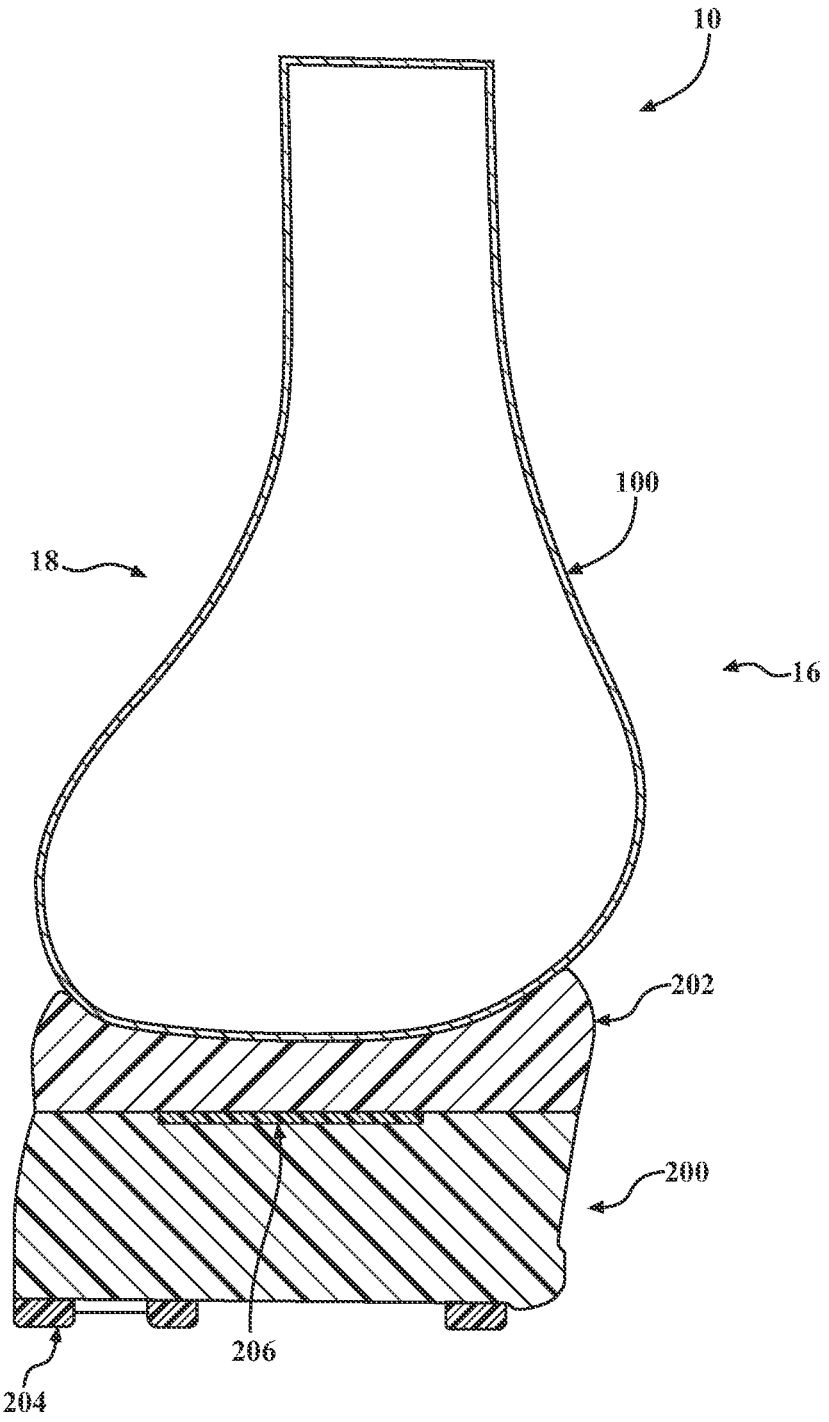
FIG. 7 is a cross-sectional view of the article of footwear of FIG. 1, taken along Line 7-7 in FIG. 3.
Figure 8:
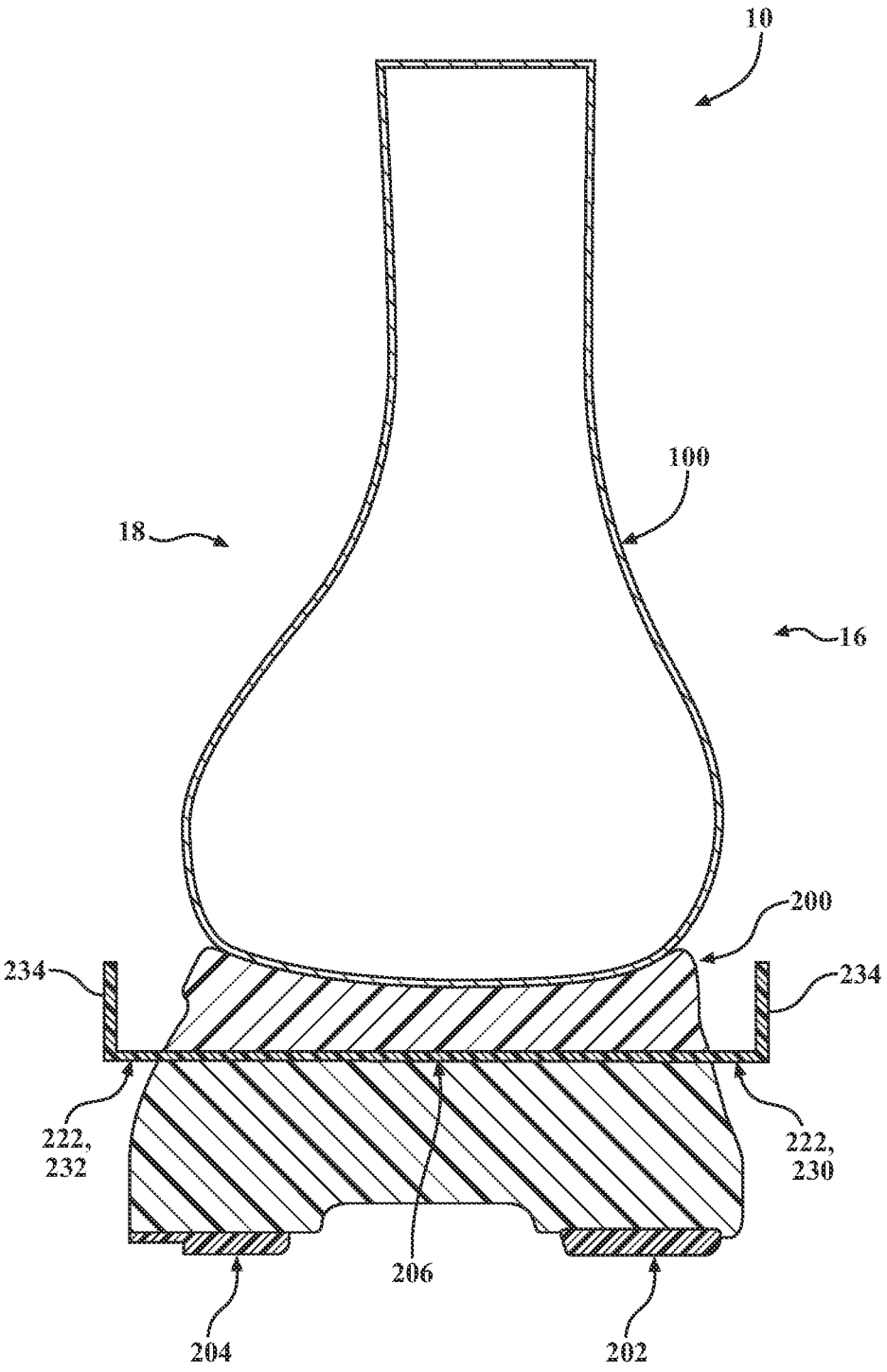
FIG. 8 is a cross-sectional view of the article of footwear of FIG. 1, taken along Line 8-8 in FIG. 3.

The various cross-sectional views shown in FIGS. 4-8 illustrate the foregoing position of the plate 206 relative to and within the midsole 202. For example, the cross-sectional views shown in FIGS. 4 and 5 illustrate the generally close proximity of the plate 206 and a ground-contacting surface (i.e., near the outsole 204) during walking and running movements. Conversely, the cross-sectional views shown in FIGS. 7 and 8 illustrate the distance the plate 206 is spaced apart from the ground-contacting surface in the heel region 24 during running and walking movements. In sum, the shape of the plate 206 allows the forces associated with running and walking movements to be directly transmitted to the plate 206 in the forefoot region 20 of the sole structure 200 while concurrently allowing the foam material of the midsole 202 to provide a degree of comfort and cushioning to the wearer in the forefoot region 20 due to the thickness of the foam material of the midsole 202 located above the plate 206 in the forefoot region 20.

Figure 9:
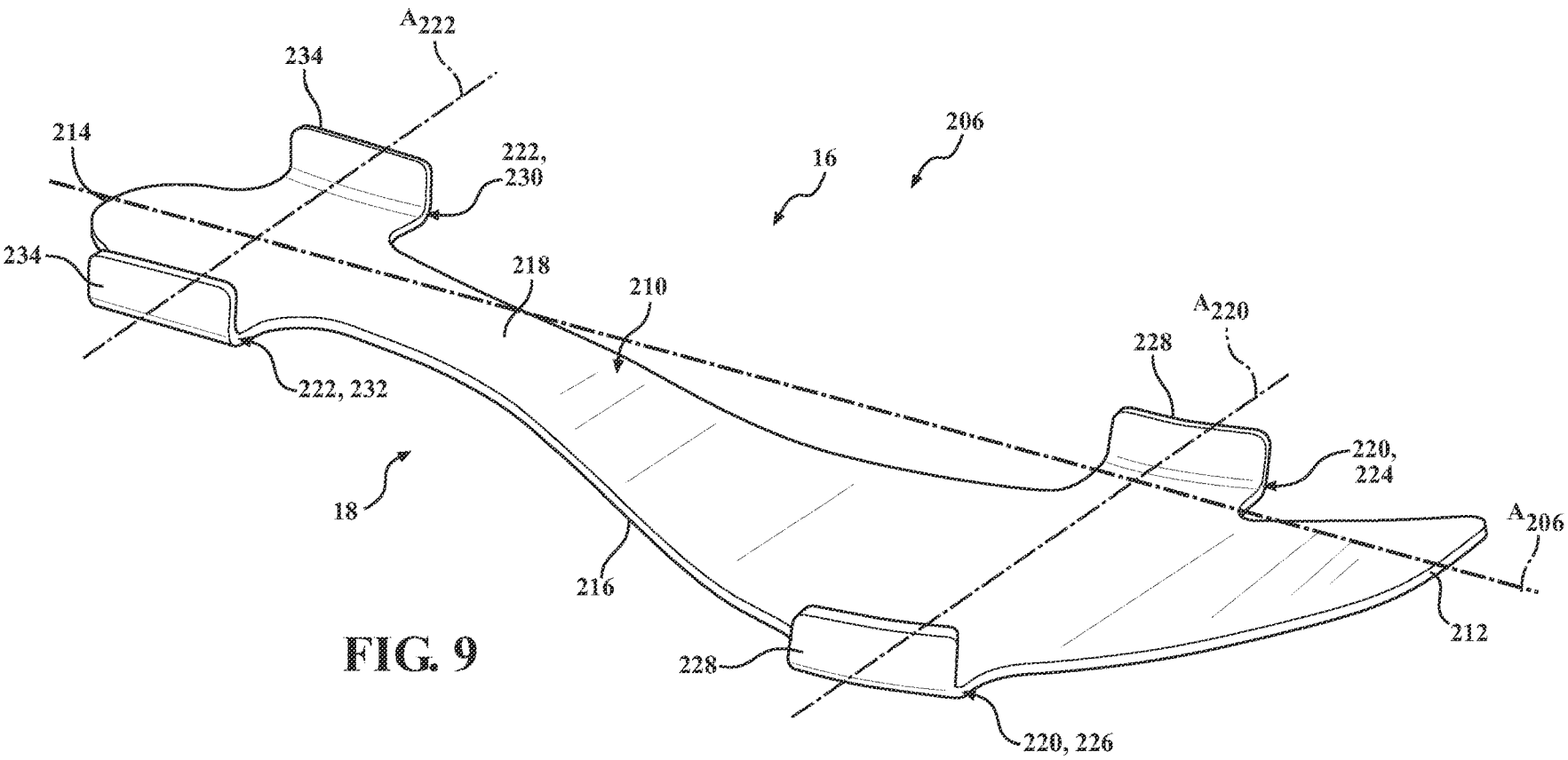
FIG. 9 is a perspective view of a plate in accordance with the principles of the present disclosure for use in a sole structure of an article of footwear.

With particular reference to FIG. 9, the plate 206 includes the main body 210 having the configuration described above, as well as the first set of projections 220 extending from the main body 210 and the second set of projections 222 extending from the main body 210. In one configuration, the first set of projections 220 extends from the main body 210 in an area of the plate 206 located in the forefoot region 20 of the sole structure 200 while the second set of projections 222 extends from the main body 210 within the heel region 24 of the sole structure 200. While the plate 206 is shown and described as including a first set of projections 220 and a second set of projections 222, the plate 206 could include only the first set of projections 220 or the second set of projections 222. While the plate 206 could include only the first set of projections 220 or the second set of projections 222, the plate 206 will be described with reference to FIGS. 1-9 as including the first set of projections 220 and the second set of projections 222.

The first set of projections 220 may include a first projection 224 disposed on a medial side of the plate 206 and a second projection 226 disposed on a lateral side of the plate 206. The first projection 224 extends from the main body 210 to a distal end. Similarly, the second projection 226 extends in an opposite direction from the plate 206 to a distal end on the lateral side 18 of the plate 206. The first projection 224 and the second projection 226 may be aligned across a width of the plate 206 such that the first projection 224 and the second projection 226 are aligned along a laterally-extending axis $A_{222}$ substantially perpendicular to a longitudinal axis $A_{206}$ of the plate 206. As such, the first projection 224 and the second projection 226 may be diametrically opposed to one another.

The first projection 224 and the second projection 226 may each include a flange 228 extending from the first projection 224 and the second projection 226. Namely, the flanges 228 may extend substantially perpendicular to the first projection 224 and the second projection 226, respectively, in a direction toward the upper 100 once the plate 206 is assembled to the midsole 202 and the midsole 202 is attached to the upper 100. As shown in FIGS. 1 and 2, the flanges 228 of the first projection 224 and the second projection 226 extend in a direction toward the upper 100 and, as such, once the plate 206 is assembled to the midsole 202 and the midsole 202 is attached to the upper 100, portions of the flanges 228 may extend along and be substantially parallel to an outer peripheral surface 208 of the midsole 202. Further, depending on the thickness of the midsole 202 disposed between the plate 206 and the upper 100, as well as the heights of the flanges 228 of the first projection 224 and the second projection 226, the flanges 228 may extend adjacent to and be spaced apart from the outer surface 112 of the upper 100.

As with the first set of projections 220, the second set of projections 222 may likewise include a first projection 230 and a second projection 232. The first projection 230 of the second set of projections 222 may extend from the main body 210 of the plate 206 in the heel region 24 and may be disposed on a medial side 16 of the plate 206. The second projection 232 of the second set of projections 222 may extend from the main body 210 of the plate 206 in the heel region 24 and may be disposed on a lateral side 18 of the plate 206. As such, the first projection 230 of the second set of projections 222 and the second projection 232 of the second set of projections 222 are disposed on opposite sides of the plate 206 from one another. Further, these projections 230, 232, as with the projections 224, 226 of the first set of projections 220, may be diametrically opposed to one another.

The first projection 230 and the second projection 232 of the second set of projections 222 may extend from the main body 210 in opposite directions and may terminate at respective distal ends. Each of the first projections 230 and the second projection 232 may include a flange 234 disposed at the distal end thereof. The flanges 234 may extend away from the first projection 230 and the second projection 232, respectively, in a direction toward the upper 100 in a similar fashion as the first projection 224 and the second projection 226 of the first set of projections 220. The flanges 234 associated with the first projection 230 and the second projection 232 may extend in a direction away from the first projection 230 and the second projection 232 substantially perpendicular to the first projection 230 and the second projection 232. As with the flanges 228 of the first projection 224 and the second projection 226 of the first set of projections 220, the flanges 234 respectively associated with the first projection 230 and the second projection 232 of the second set of projections 222 may extend along an outer surface of at least one of the outer perimeter surface 208 of the midsole 202 and the upper 100.

As shown in FIGS. 3 and 9, the flanges 228 associated with the first projection 224 and the second projection 226 of the first set of projections 220 may be substantially parallel to the flanges 234 of the first projection 230 and the second projection 232 of the second set of projections 222. Further, the flanges 228 may be spaced apart and separated from the flanges 234 in a direction extending along the longitudinal axis (L) of the plate 206. Finally, the flanges 228 associated with the first projection 224 and the second projection 226 may be spaced apart from one another by a greater distance than the flanges 234 associated with the first projection 230 and the second projection 232 due to the main body 210 of the plate 206 being wider in the forefoot region 20 of the sole structure 200 as compared to the width of the main body 210 at the heel region 24 of the sole structure 200.

As described above, the plate 206 may include a composite material. Namely, the plate 206 may be formed from a carbon-fiber composite material, which allows the plate 206 to have varying degrees of stiffness at different locations along the length and/or width of the plate 206. In one configuration, the main body 210 of the plate 206 is relatively flexible in a longitudinal direction of the plate 206 and is relatively rigid in a lateral direction of the plate 206. Namely, the main body 210 may more easily flex about an axis extending substantially perpendicular to the longitudinal axis $A_{206}$ of the plate 206 while resisting bending about the longitudinal axis $A_{206}$ of the plate 206.

The composite nature of the plate 206 additionally allows the main body 210 to include localized degrees of strength and rigidity. For example, the main body 210 may be locally reinforced at locations of one or both of the first set of projections 220 and the second set of projections 222. In one configuration, the main body 210 of the plate 206 is stiffest and, thus, resists bending along the lateral axis $A_{220}$ extending between the first projection 224 and the second projection 226 of the first set of projections 220.

While the plate 206 is described and shown as being disposed close to a ground surface during use, the plate 206 could have a different shape and/or be positioned closer to the upper 100 in the forefoot region 20 such that the material of the midsole 202 extends between the plate 206 and the outsole 204 in forefoot region 20. Further, a cushion (not shown) may be disposed between the plate 206 and the outsole 204 as an alternative or in addition to the material of the midsole 202. For example, a fluid-filled chamber (not shown) could be positioned between the plate 206 and the outsole 204 in at least one of the forefoot region 20, the mid-foot region 22, and the heel region 24. Regardless of the particular shape and position of the plate 206, the plate 206 distributes loads applied at the forefoot region 14 as a wearer rolls through a walking or running movement and helps apply torque about the wearer's ankle.

Figure 10:
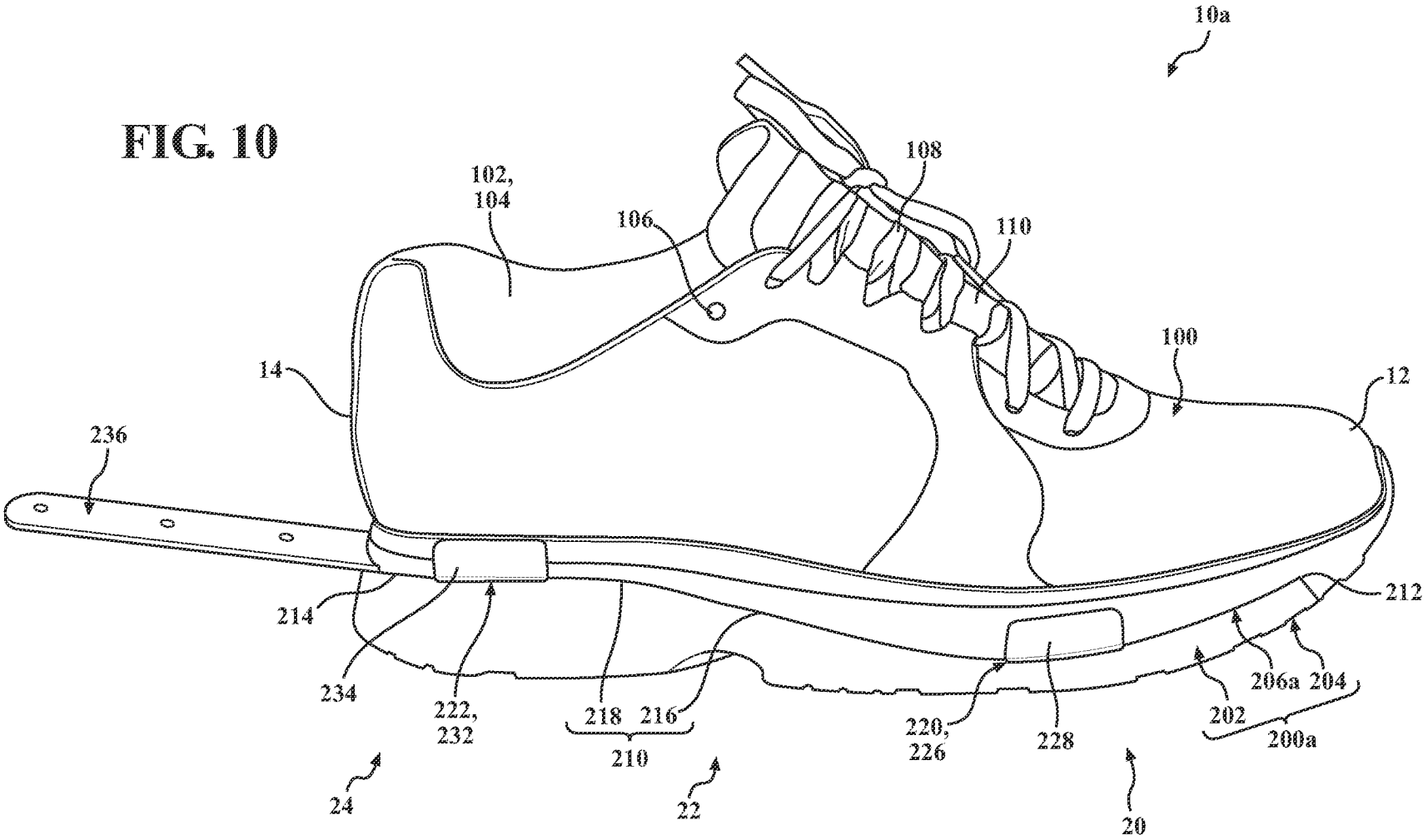
FIG. 10 is a side view of an article of footwear incorporating a plate in accordance with the principles of the present disclosure, the plate shown in conjunction with an external structure.
Figure 11:
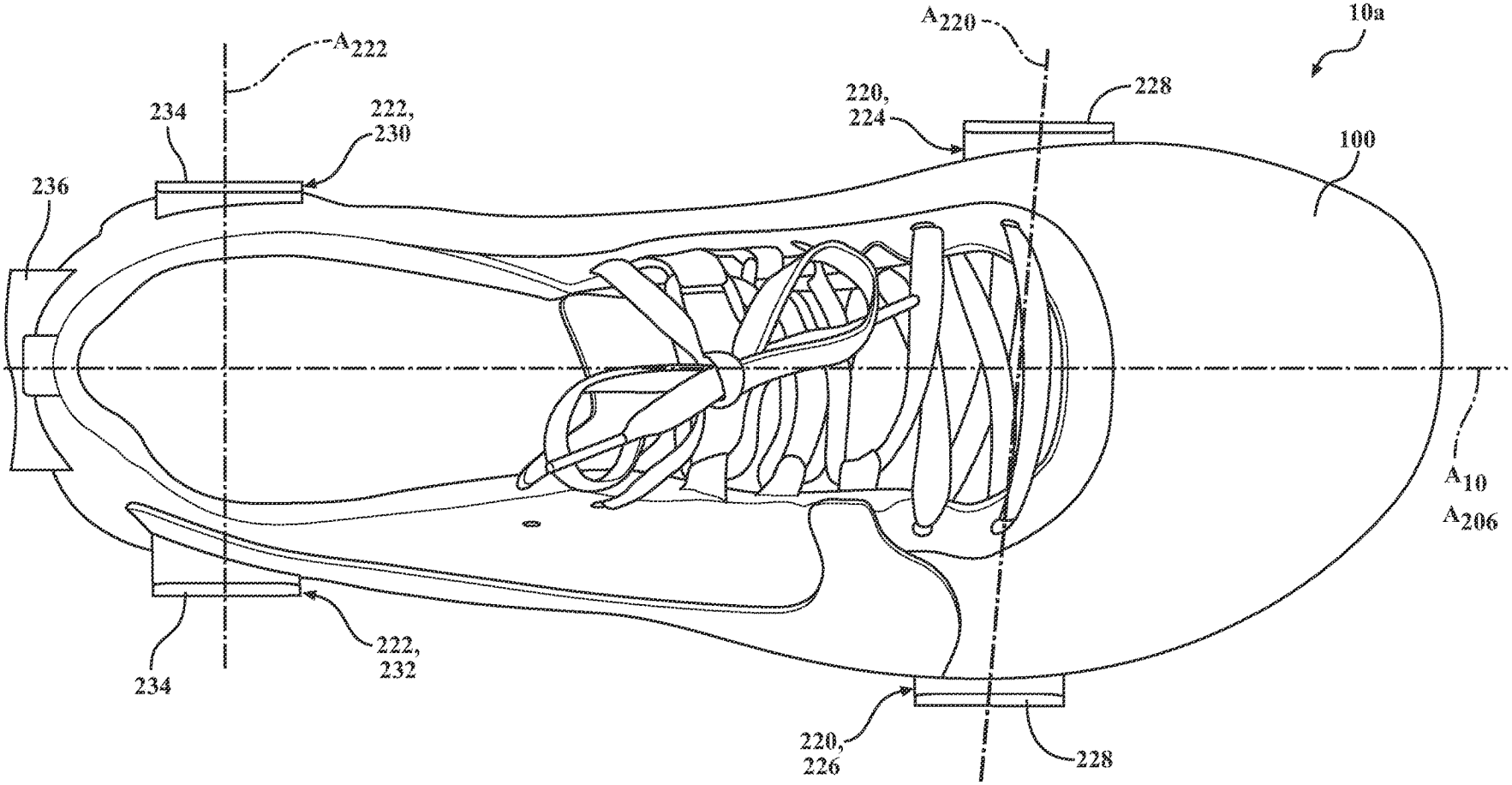
FIG. 11 is a top view of the article of footwear of FIG. 10.
Figure 12:
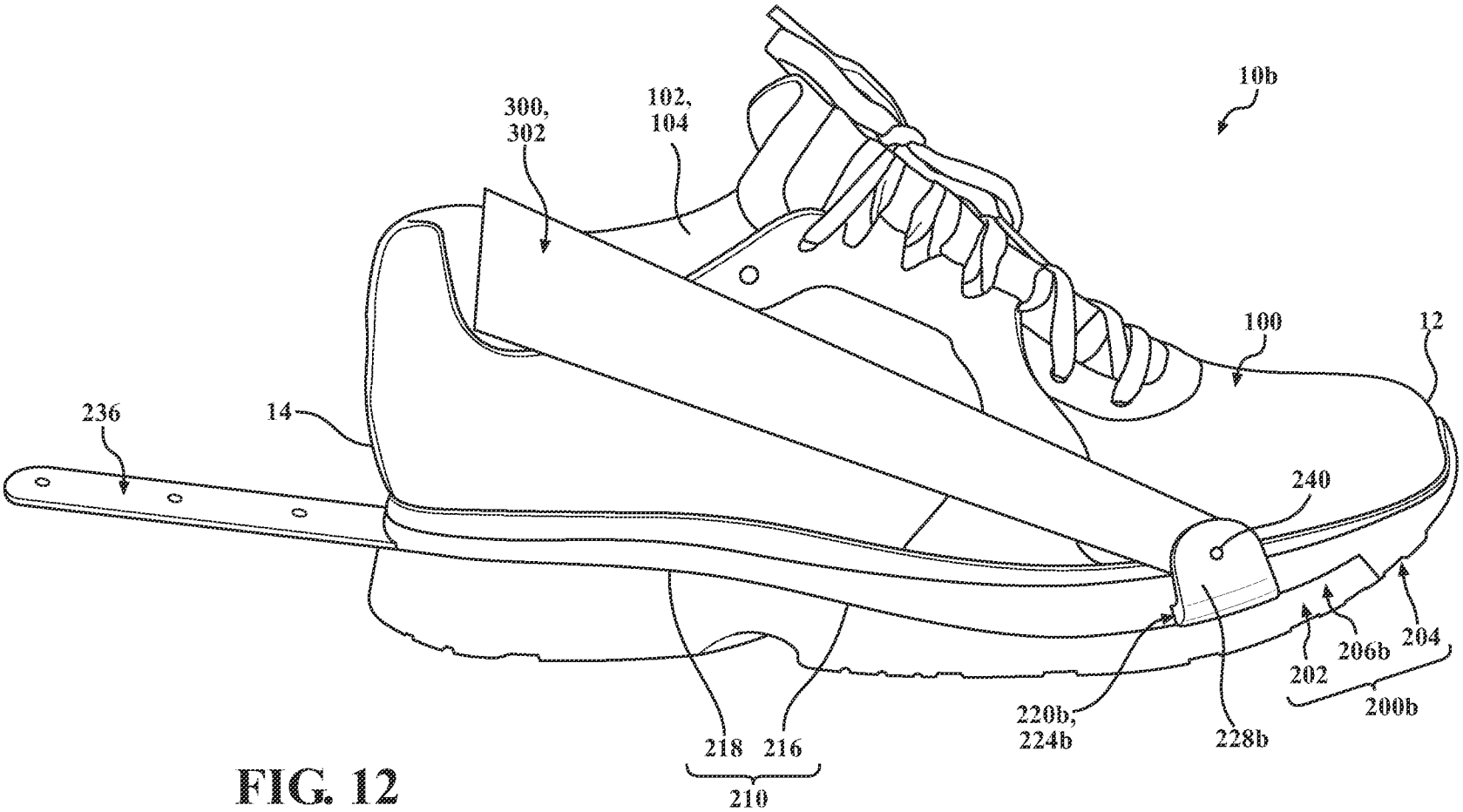
FIG. 12 is a side view of an article of footwear incorporating a plate in accordance with the principles of the present disclosure, the plate shown in conjunction with an external structure.

With particular reference to FIGS. 10 and 11, another example of a plate 206*a* is shown incorporated into an article of footwear 10*a*. Given the similarity in structure and function of the article of footwear 10*a* with respect to the article of footwear 10, like reference numerals will be used hereinafter and in the drawings to identify like components while reference numerals containing letter extensions will be used to identify those components that have been modified.

As shown in FIG. 11, the flanges 228 of the first projection 224 and the second projection 226 are spaced apart from and oppose the outer, peripheral surface 208 of the midsole 202. Namely, the first projection 224 and the second projection 226 extend from the outer, peripheral surface 208 within the forefoot region 20 of the sole structure 200*a*. Likewise, the first projection 230 and the second projection 232 of the second set of projections 222 are spaced apart from and oppose the outer, peripheral surface 208 of the midsole 202 in the heel region 24 of the sole structure 200*a*. As such, the first set of projections 220 and the second set of projections 222 are exposed and visible during use of the article of footwear 10*a*. As will be described in greater detail below, the projections 224, 226, 230, 232 of the first set of projections 220 and the second set of projections 222, respectively, allow the plate 206*a* and, thus, the sole structure 200*a* and associated article of footwear 10*a* to be selectively attached to an external structure such as, for example, an exoskeleton 300.

While the plate 206 is described and shown as including the first set of projections 220 and the second set of projections 222, the plate 206 could additionally include a projection 236 that extends from the main body 210 at a location that is spaced apart from the locations of the first set of projections 220 and the second set of projections 222. For example, the projection 236 may be located in the heel region 24 and may extend from the outer, peripheral surface 208 of the midsole 202 at the heel region 24. The projection 236 may likewise facilitate attachment of the plate 206 to an external structure such as an exoskeleton and may be exposed during use of the article of footwear 10*a*. As shown in FIGS. 10 and 11, the projection 236 may extend from the outer, peripheral surface 208 of the midsole 202 in at the heel region 24 and may be positioned such that the projection 236 is substantially perpendicular to the outer, peripheral surface 208.

With particular reference to FIGS. 12-16, an article of footwear 10*b* is provided and includes a sole structure 200*b* including a plate 206*b*. In view of the substantial similarity in structure and function of the article of footwear 10*b* with respect to the article of footwear 10*a*, like reference numerals are used hereinafter and in the drawings to identify like components while reference numerals containing letter extensions are used to identify those components that have been modified.

The plate 206*b* is similar to the plate 206, but only includes a first set of projections 220*b* and the optional projection 236. Further, the main body 10 of the plate 206*b* may include the same overall shape as the plate 206 described above with respect to the article of footwear 10 and may be formed from the materials described above with respect to the plate 206.

The plate 206*b* may include the first set of projections 220*b* that extend from the plate 206*b* in the forefoot region 20. The first set of projections 220*b* may include a first projection 224*b* extending from the main body 210 of the plate 206*b* at the medial side of the main body 210 and a second projection 226*b* extending from the main body 210 of the plate 206*b* at the lateral side of the main body 210. The first projection 224*b* and the second projection 226*b* may each include a pair of flanges 228*b* that extend from the first projection 224*b* and the second projection 226*b*, respectively, in a direction toward the upper 100. As with the first projection 224 and the second projection 226 of the plate 206 described above, the flanges 228*b* of the first projection 224*b* and the second projection 226*b* may extend from the first projection 224*b* and the second projection 226*b* in a direction substantially perpendicular to the first projection 224*b* and the second projection 226*b*, respectively.

Each of the first projection 224*b* and the second projection 226*b* includes a pair of flanges 228*b* that are (i) spaced apart from each other along the lateral direction extending substantially perpendicular to the longitudinal axis $A_{206}$ of the plate 206*b* by a gap 238 and (ii) may be substantially parallel to each other. Each flange 228*b* of each projection 224*b*, 226*b* may include an aperture 240 formed through a thickness of the flange 228*b*. The apertures 240 of the flanges 228*b* of the first projection 224*b* may be aligned with one another along a first common axis $A_{240}$ extending parallel to the lateral axis $A_{220}b$. Likewise, the apertures 240 of the flanges 228*b* of the second projection 226*b* may be aligned with one another along a second common axis $A_{240}$. Thus, as discussed below, the flanges 228*b* may be configured as hinges for pivotally attaching an external structure 300.

As with the plate 206, the plate 206*b* may be include a composite material such as, for example, a carbon fiber composite material. The carbon fiber composite material of the plate 206*b* may include a relatively high rigidity and resistance to bending at a location of the first projection 224*b* and the second projection 226*b*. Namely, the main body 210 of the plate 206*b* may be locally reinforced along a longitudinal axis extending between and through the first projection 224*b* and the second projection 226*b*. In so doing, the main body 210 of the plate 206*b* includes the highest resistance to bending at a location of the first set of projections 220*b*.

Figure 14:
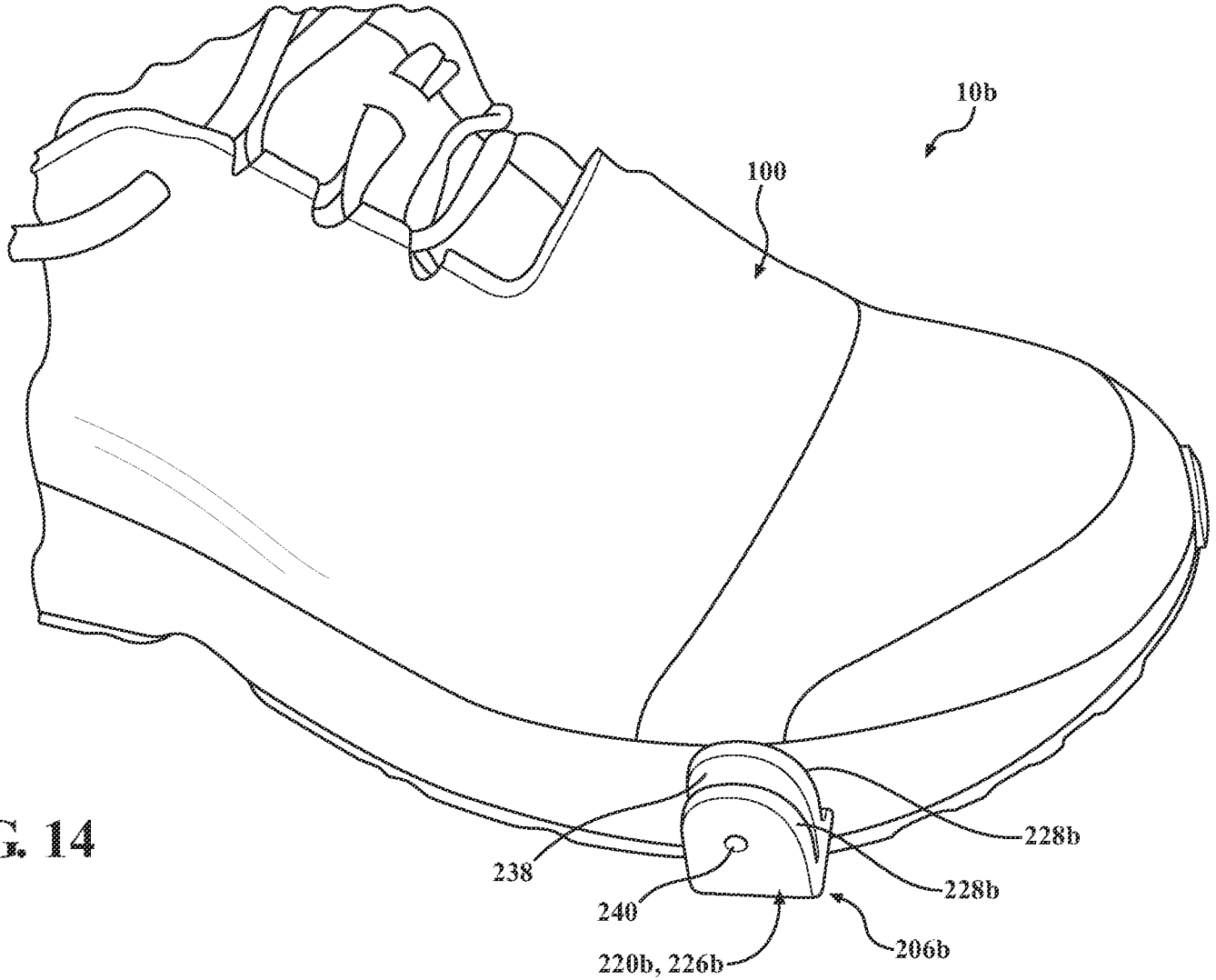
FIG. 14 is a partial perspective view of the plate and external structure of FIG. 12 shown in conjunction with an article of footwear.
Figure 15:
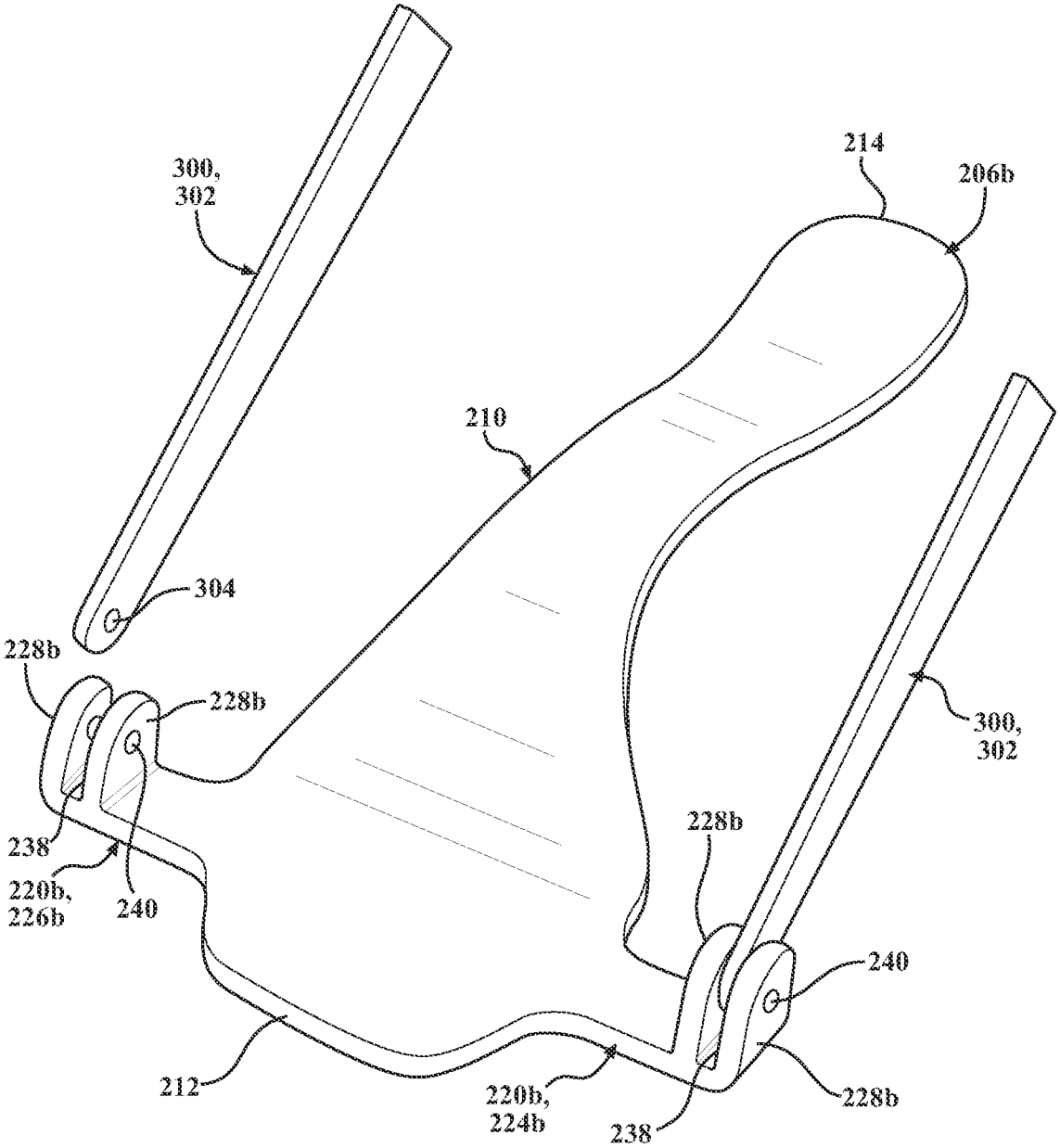
FIG. 15 is a perspective view of a plate in accordance with the principles of the present disclosure for use in a sole structure of an article of footwear, the plate shown in conjunction with an external structure.
Figure 16:
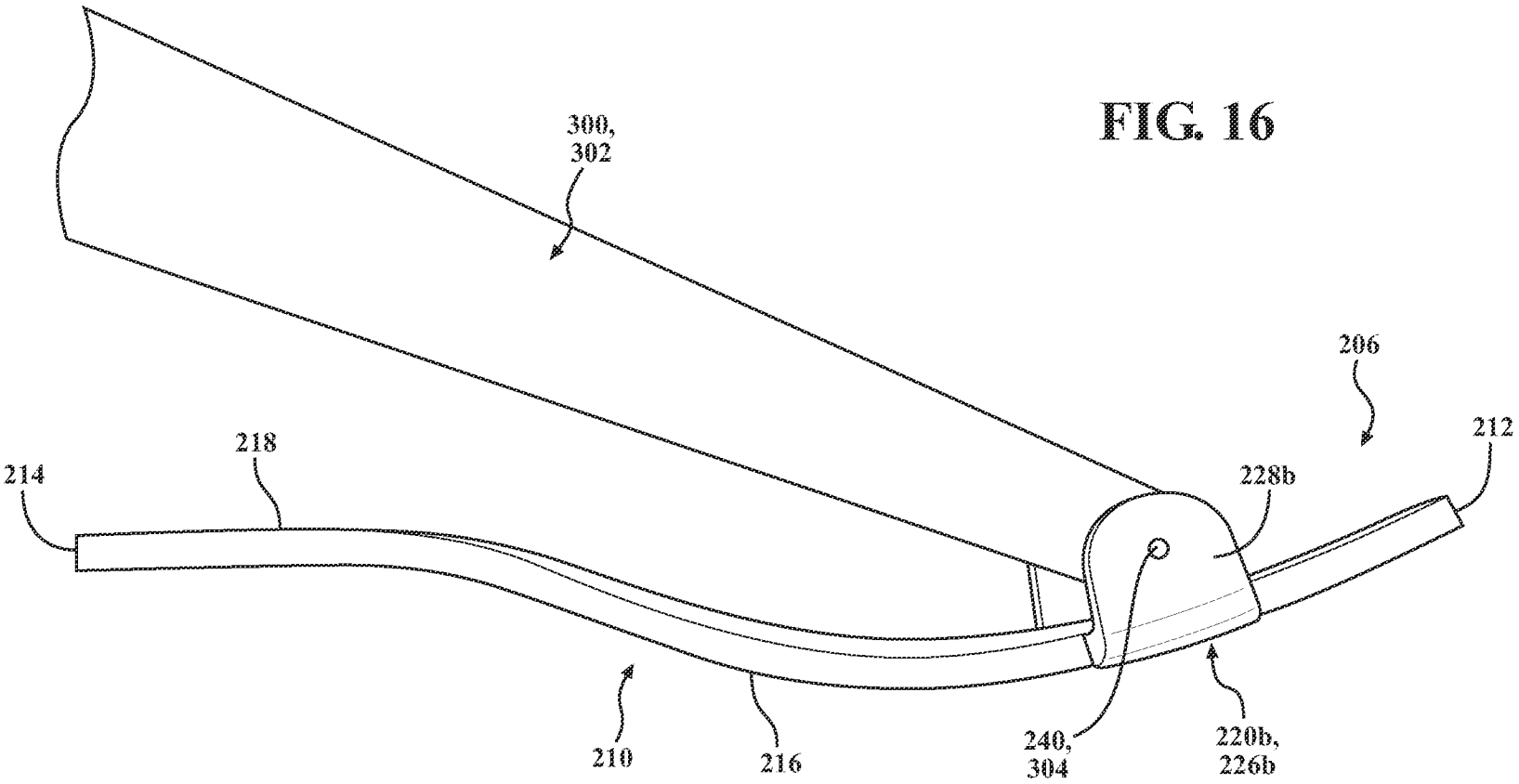
FIG. 16 is a side view of the plate and external structure of FIG. 12.

As shown in FIGS. 14-16, the first set of projections 220*b* may allow the plate 206*b* and, thus, the article of footwear 10*b* to be attached to an external structure 300. For example, the first set of projections 220*b* may allow the plate 206*b* to be attached to an external structure such as an exoskeleton. The exoskeleton 300 may include a bracket 302 that is received within the gap 238 between the flanges 228*b* of each projection 224*b*, 226*b*. The bracket 302 may include an aperture 304 that may be aligned with the apertures 240 of the flanges 228*b* when the bracket 302 is attached to the first projection 224*b*.

Once the apertures 240 of the flanges 228*b* and the apertures 304 of the bracket 302 are axially aligned, a fastener (not shown) may be inserted into the apertures 240 of the flanges 228*b* of the first projection 224*b* and through the aperture of the bracket 302 to pivotally attach the bracket 302 to the first projection 224*b*. A similar procedure can be followed on both the medial side and the lateral side of the main body 210 of the plate 206*b* such that a pair of brackets 302 are simultaneously and pivotally attached to the plate

206*b* at the first projection 224*b* and the second projection 226*b*, respectively. Because the brackets 302 are pivotally attached to the plate 206*b* via the flanges 228*b*, the flanges 228*b* act as a hinge that pivotally attaches the brackets 302 to the plate 206*b*.

Attaching the plate 206*b* to the brackets 302 of the exoskeleton 300 allows the plate 206*b* and, thus, the article of footwear 10*b* to be pivotally attached to the exoskeleton 300 via the brackets 302. Further, because the plate 206*b* is positioned in a fixed position relative to the midsole 202, and the midsole 202 is in a fixed position relative to the upper 100, a position of the first projection 224*b* and the second projection 226*b* relative to the midsole 202 and the upper 100 is likewise fixed and constant. Accordingly, attachment of the brackets 302 and, thus, the exoskeleton to the plate 206*b* is repeatable. In other words, the relative position of the brackets 302, the midsole 202, and the upper 100 may be repeated over multiple occasions when the brackets 302 are removed and reinstalled on the article of footwear 10*b*.

Figure 13:
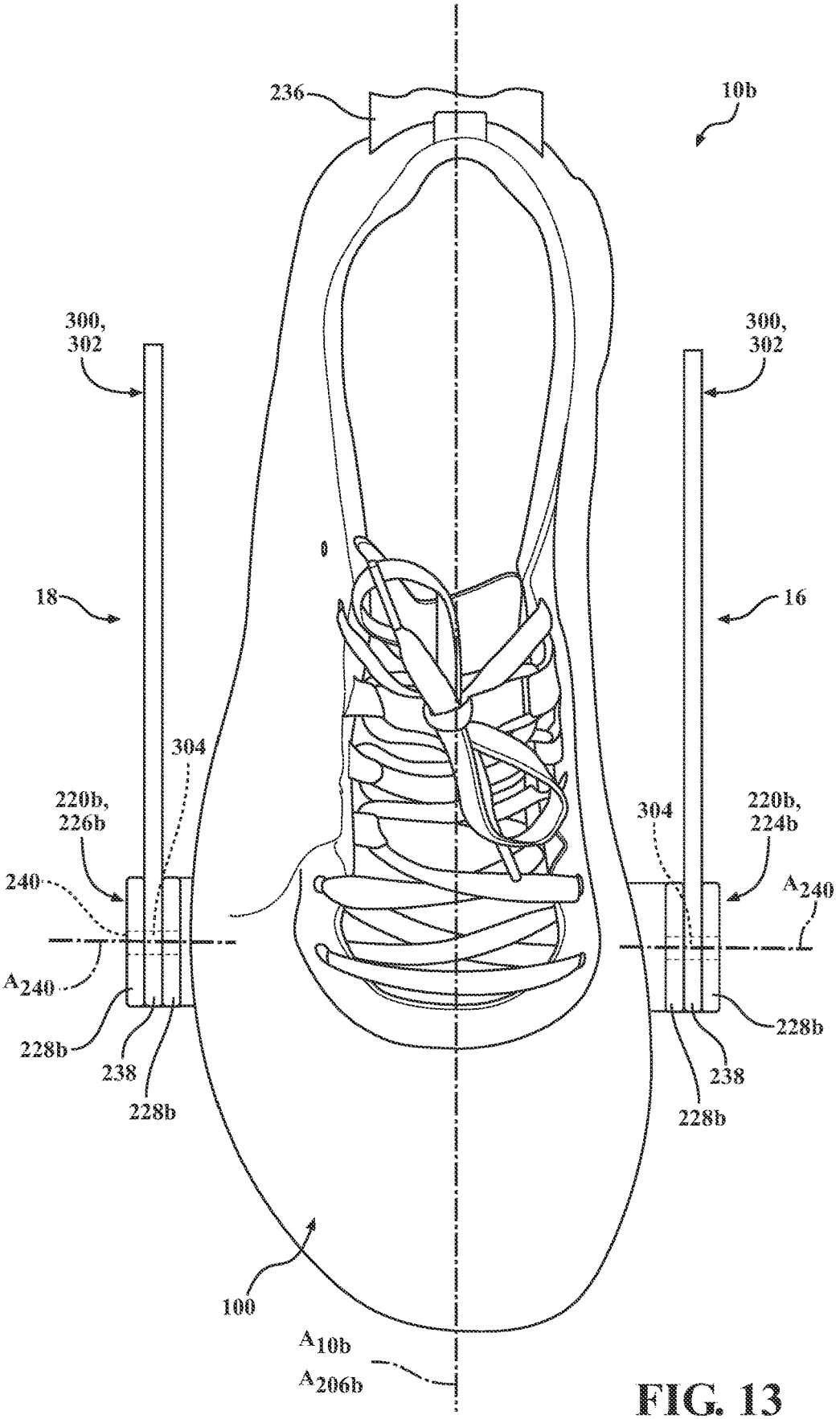
FIG. 13 is a top view of the article of footwear of FIG. 11.

When the brackets 302 are pivotally attached to the first projection 224*b* and the second projection 226*b*, the brackets 302 extend along a portion of the outer, peripheral surface 208 of the midsole 202 and along an outer surface of the upper 100, as shown in FIG. 13. FIGS. 13 and 14 additionally show a first, inner one of the flanges 228*b* of the first projection 224*b* being located adjacent to and opposing the outer, peripheral surface 208 of the midsole 202 while a second, outer one of the flanges 228*b* of the first projection 224*b* is spaced apart from the outer, peripheral surface 208 of the midsole 202 by the gap 238 as well as a thickness of the inner flange 228*b*. In one configuration, the inner flange 228*b* abuts the outer peripheral surface 208 of the midsole 202. Alternatively, the inner flange 228*b* may be spaced apart from the outer, peripheral surface 208 of the midsole 202 by a predetermined distance.

Figure 17:
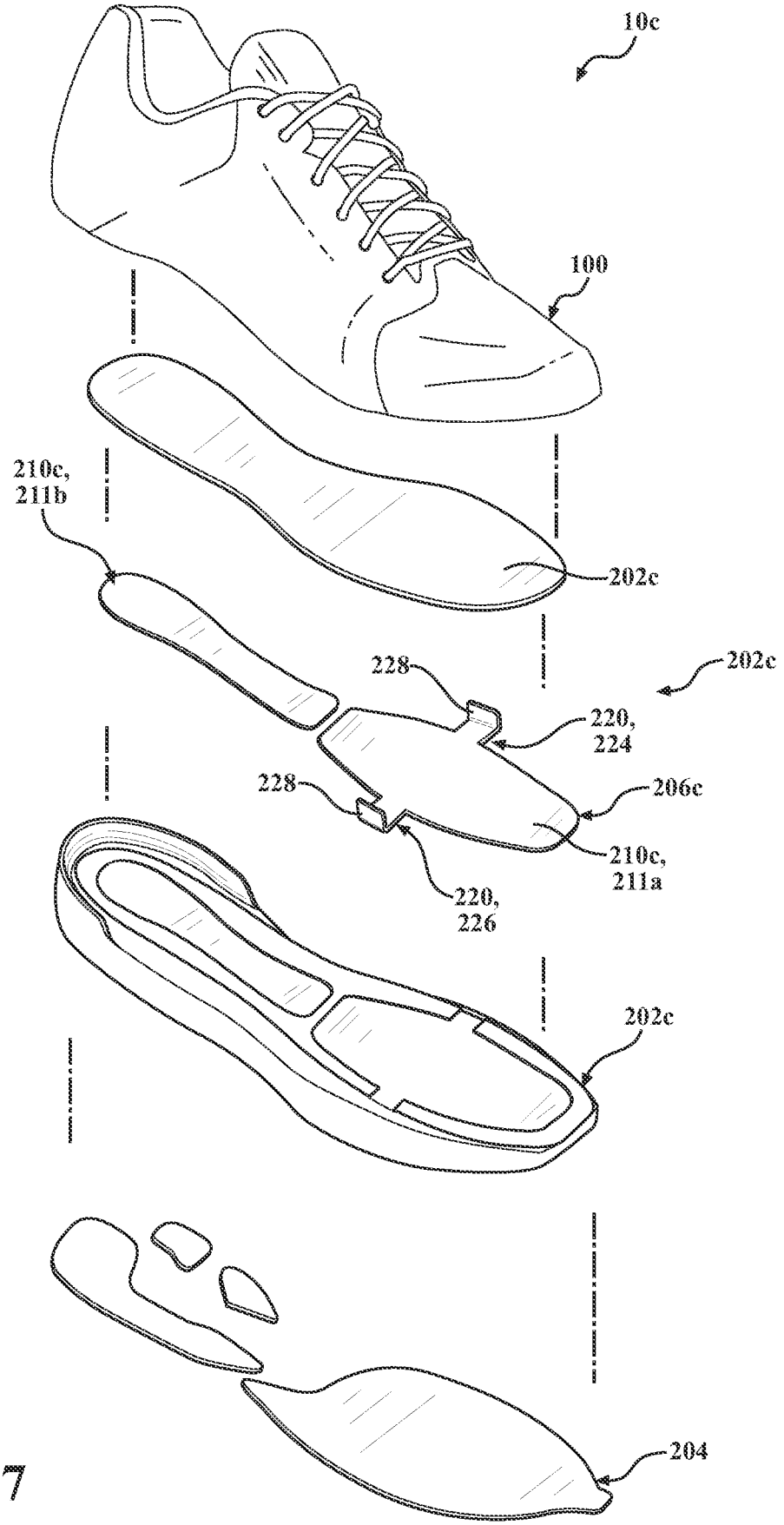
FIG. 17 is an exploded perspective view of a sole structure and article of footwear in accordance with the principles of the present disclosure.

With particular reference to FIG. 17, an article of footwear 10*c* is shown. In view of the substantial similarity in structure and function of the article of footwear 10*c* with respect to the article of footwear 10*a*, like reference numerals are used hereinafter and in the drawings to identify like components while reference numerals containing letter extensions are used to identify those components that have been modified.

The sole structure 200*c* of the article of footwear 10*c* is virtually identical to the article of footwear 10*b* with the exception of the plate 206*c* having a two-part construction. Namely, the main body 210*c* of the plate 206*c* includes a first portion 211*a* disposed in a forefoot region 20 of the article of footwear 10*c* and a second portion 211*b* disposed in the heel region 24 of the article of footwear 10*c*. The first portion 211*a* extends from the anterior end 12 in a direction toward the posterior end 14 and past the metatarsophalangeal (MTP) point. The first portion 211*a* includes the first set of projections 220 and, thus, serves to selectively attach the first portion 211*a* of the plate 206*c* to the brackets 302 of the exoskeleton, as described above with respect to the plate 206*b*. Optionally, the second portion 211*b* may include the second set of projections 222, as discussed above. The first portion 211*a* and the second portion 211*b* are aligned with one another along the longitudinal axis $A_{10}$ once assembled to the midsole 202. Optionally, the midsole 202*c* of the sole structure 200*c* may include separate recesses configured to receive the portions 211*a*, 211*b* of the main body 210*c* therein.

As shown in FIG. 18, a sole structure 200*d* of an article of footwear 10*d* may include a tunnel structure 242 disposed in the heel region 24. The tunnel structure 242 may be incorporated into any one of the articles of footwear 10-10*c* described above. For example, a tunnel structure 242 formed from a low-friction, high molecular, lightweight material may be disposed in the heel region 24. The tunnel structure 242 may define a bore 244 that extends from the medial side 16 to the lateral side 18 and provides access through the sole structure 200*d*. The tunnel structure 242 may be formed from a low-friction, high molecular, lightweight material that has a low coefficient of friction. The bore 244 formed by the tunnel structure 242 allows the article of footwear 10*d* to be selectively attached to the exoskeleton via a tether 246.

The tether 246 may be formed from a woven or braided element such as a rope or cable that extends from the exoskeleton to the article of footwear 10*d*. For example, the tether 246 may be formed from a rope that extends from the exoskeleton down to the tunnel structure 242 at the medial side 16, through the bore 244, out the lateral side 18, and returns to the exoskeleton. In so doing, the tether 246 attaches the article of footwear 10*d* to the exoskeleton and permits movement of the exoskeleton in a direction toward the article of footwear 10*d*. However, during operation, when an upward force is exerted on the exoskeleton in a direction away from the article of footwear 10*d*, and the tether 246 is placed in tension, attachment of the tether 246 to the tunnel structure 242 restricts movement of the exoskeleton 300 a predetermined distance away from the article of footwear 10*d*. Namely, the exoskeleton is only permitted to move a distance away from the article of footwear 10*d* substantially equivalent to a length of the tether 246 at the medial side and the lateral side.

With particular reference to FIG. 19, the heel region 24 of a sole structure 200*e* of an article of footwear 10*e* is shown as including a pair of projections 248 that extend between the medial side 16 and the lateral side 18 of a plate 206*e*. The projections 248 may be formed by the material of the plate 206*e* in an effort to help locate and retain a position of the plate 206*e* relative to the midsole 202*e*. Further, the projections 248 may additionally define a channel that receives an adhesive material to secure a desired position of the tunnel structure 242 between the projections 248 and relative to the plate 206*e*. In so doing, the projections 248 may cooperate with the tunnel structure 242 to ensure that the bore 244 defined by the tunnel structure 242 is held in a desired position relative to the midsole 202*e* and plate 206*e* and, thus, the exoskeleton during use.

Figure 20:
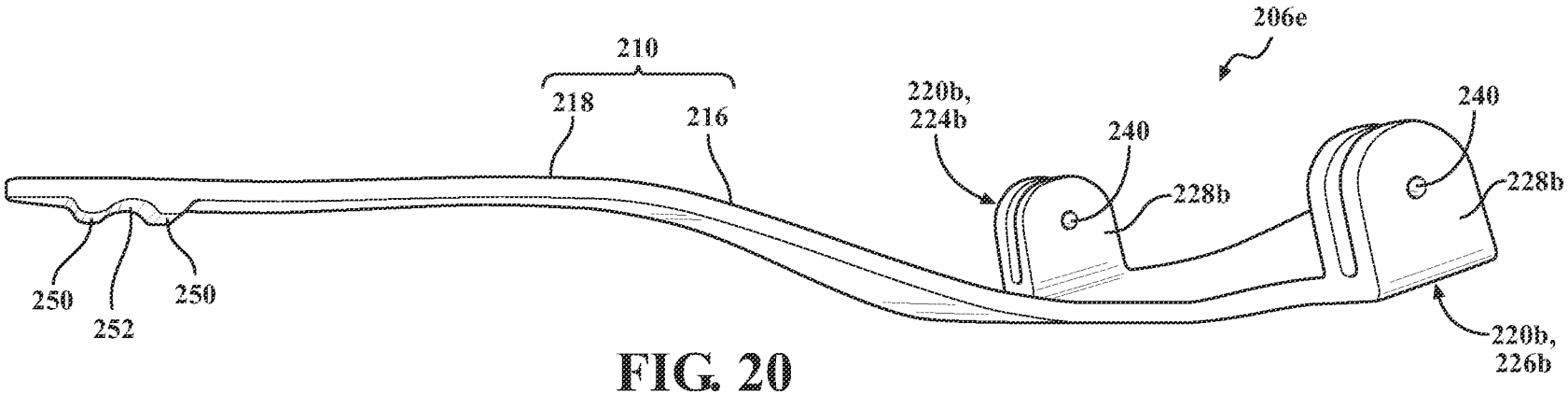
FIG. 20 is a rear perspective view of a plate in accordance with the principles of the present disclosure for use in a sole structure of an article of footwear.
Figure 21:
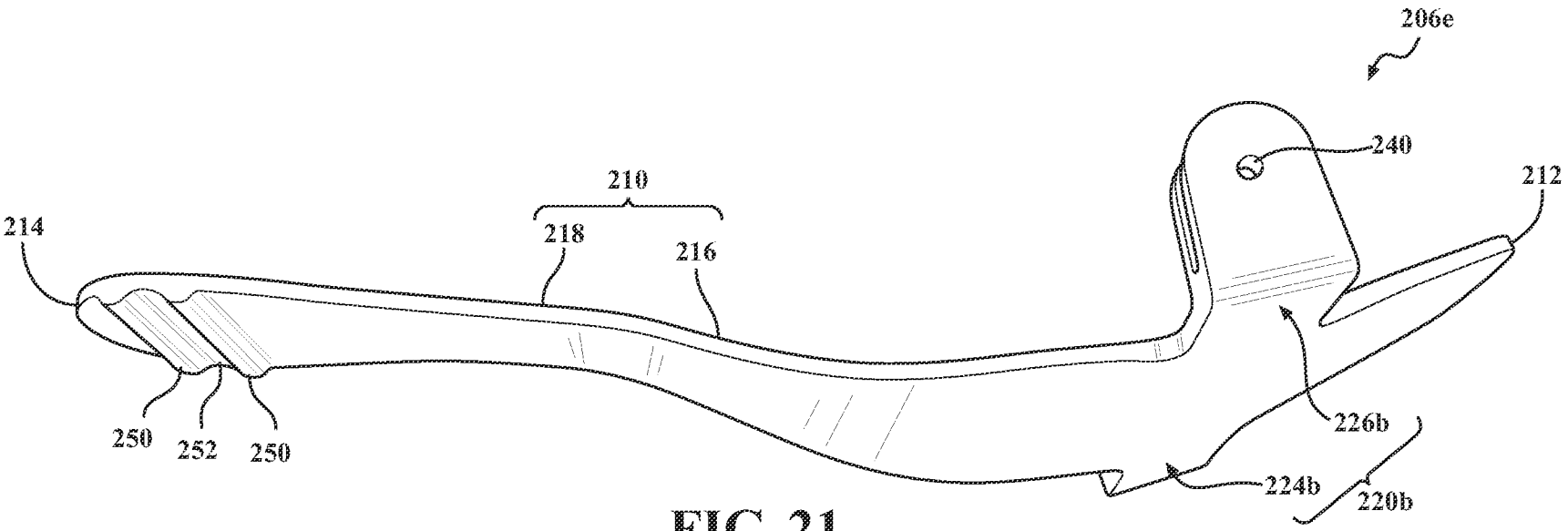
FIG. 21 is a bottom perspective view of the plate of FIG. 20.
Figure 22:
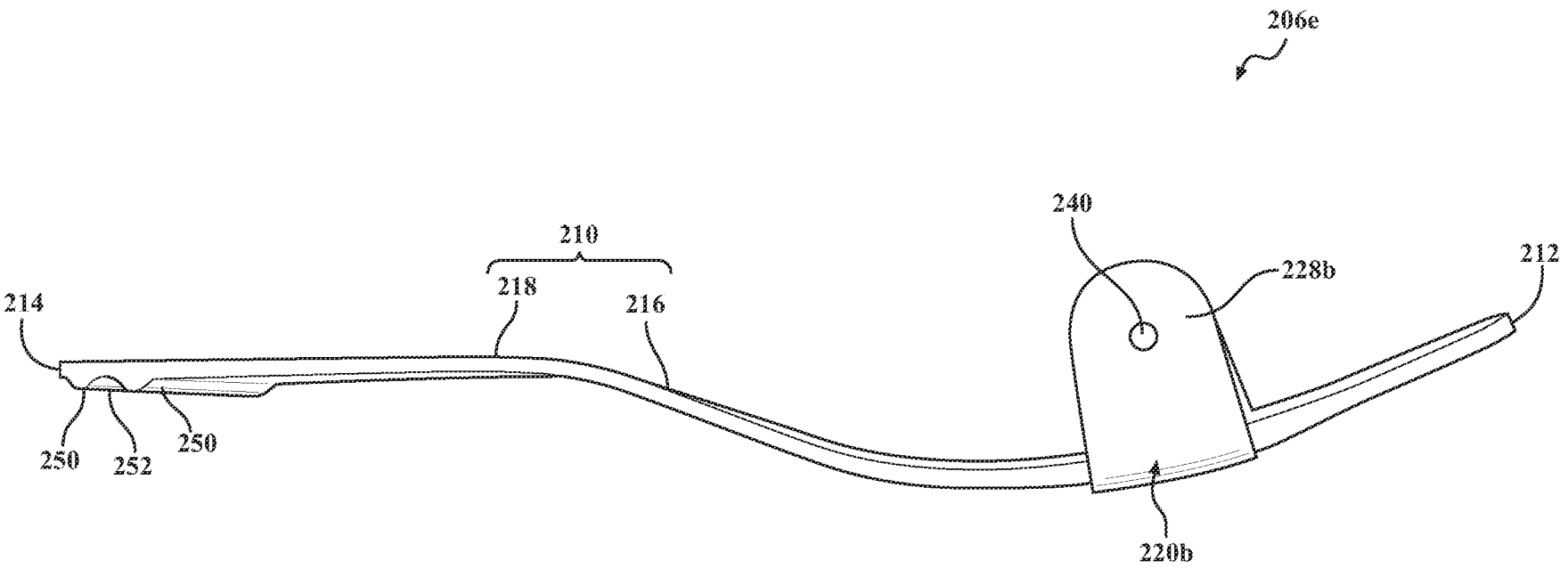
FIG. 22 is a side view of the plate of FIG. 20.

With particular reference to FIGS. 20-22, the plate 206*e* is shown as including projections 250 that cooperate to define a channel 252. The channel 252 is positioned in a heel region of the plate 206*e* and may receive the tunnel structure 242 therein to aid in retaining and positioning the tunnel structure 242 relative to and within the midsole 202*e*. The plate 206*e* is substantially similar to the plate 206*b* with the exception of the projections 250 and channel 252.

Figure 23:
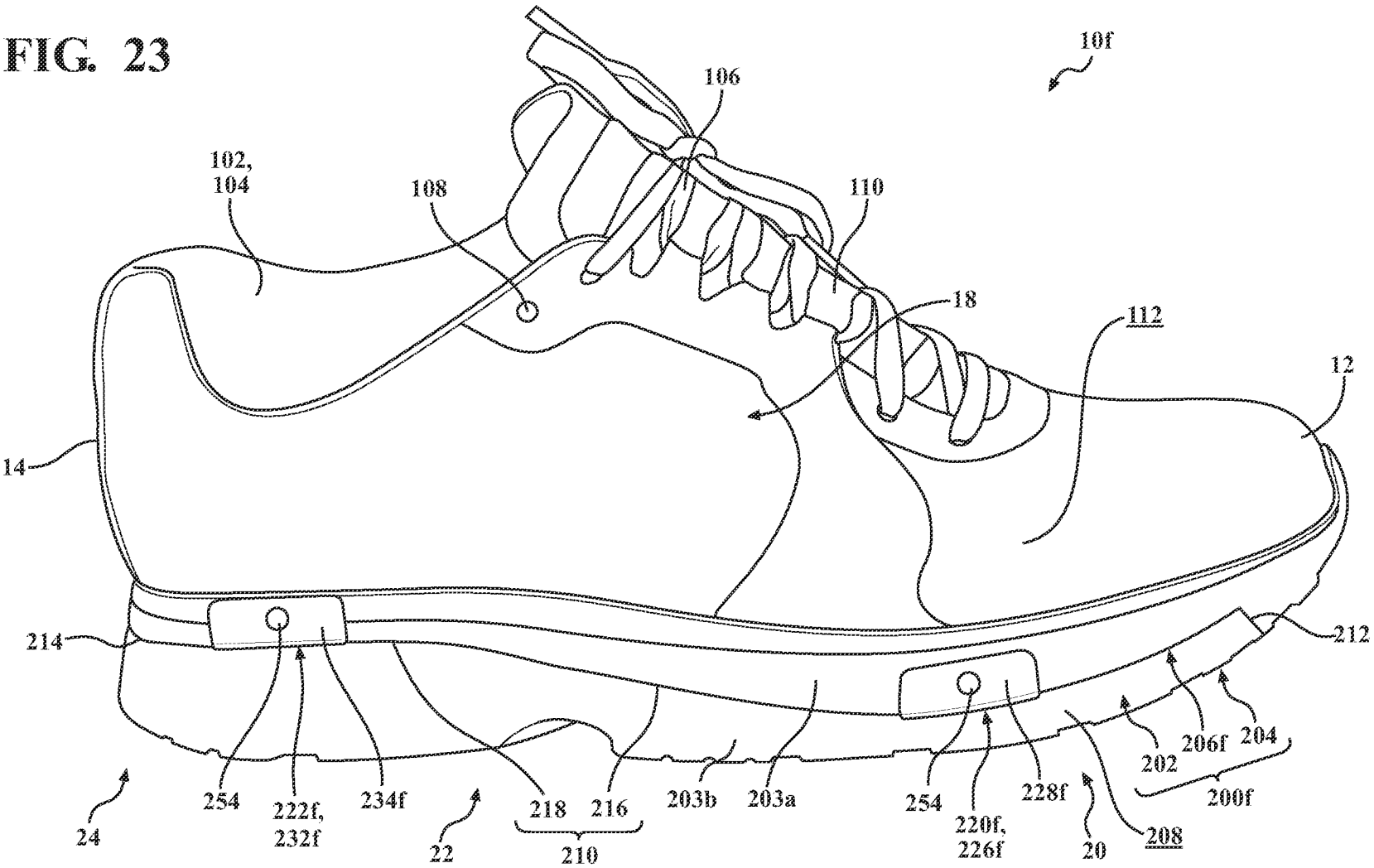
FIG. 23 is a lateral side view of an article of footwear in accordance with the principles of the present disclosure.
Figure 24:
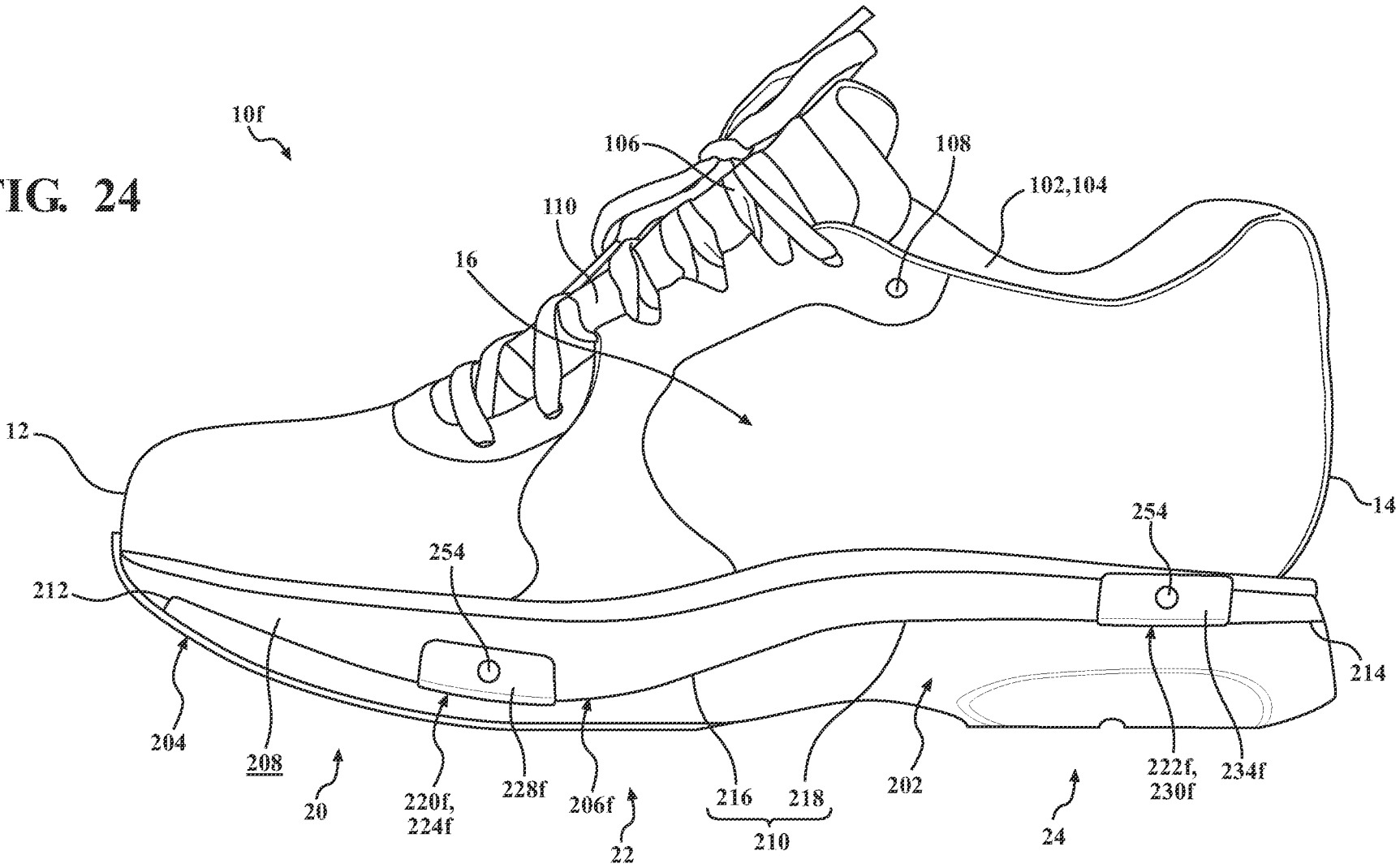
FIG. 24 is a medial side view of the article of footwear of FIG. 23.

With particular reference to FIGS. 23 and 24, an article of footwear 10*f* is provided and includes a plate 206*f* incorporated into a sole structure 200*f* In view of the substantial similarity in structure and function of the article of footwear 10*f* with respect to the article of footwear 10, like reference numerals are used hereinafter and in the drawings to identify like components while reference numerals containing letter extensions are used to identify those components that have been modified.

In this example, flanges 228*f*, 234*f* of the at least one of the sets of projections 220*f*, 222*f* could each be provided with an aperture 254 in a similar fashion as the flanges 228*b* of the first projection 224*b* and the second projection 226*b*. The aperture 254 receives a respective tether 246 for selectively attaching the plate 206*f* and, thus, the article of footwear 10*f* and the exoskeleton. For example, the flanges 234*f* of the first projection 230*f* and the second projection 232*f* may include apertures 250 that function in a similar manner as the bore 244 of the tunnel structure 242 of FIG. 18 by allowing the exoskeleton to be selectively attached to the plate 206*f* and, thus, the article of footwear 10*f* while concurrently preventing the exoskeleton from moving a predetermined distance away from the article of footwear 10*a* during use. Optionally, flanges 224*f*, 226*f* of the first set of projections 220*f* may also include apertures 254 for attaching the exoskeleton 300.

Similarly, an exoskeleton may be attached to the article of footwear 10*f* via the bracket 302 and the tether 246. The exoskeleton may aide a wearer of the article of footwear 10*f* during walking and/or running movements by reducing the amount of energy required to propel the wearer and may extend up from the article of footwear 10*f* toward a calf of the wearer. Additionally, because the plate 206*c* is described as including a portion disposed in the forefoot region 20 that is close to the ground-contacting surface and a heel portion that is disposed near a foot of the wearer, rotation about the ankle is achieved and allows for rotation about the heel.

The following Clauses provide exemplary configurations for a sole structure for an article of footwear described above.

Clause 1: A sole structure for an article of footwear having an upper, the sole structure comprising an outsole having a ground-engaging surface and an upper surface formed on an opposite side of the outsole than the ground-engaging surface, a midsole attached to the outsole and including an outer perimeter surface extending between the outsole and the upper, and a plate disposed at least partially within the midsole and extending (i) from a forefoot region of the sole structure, (ii) through a metatarsophalangeal (MTP) point of the sole structure, and (iii) toward a heel region of the sole structure, the plate including a first plate portion extending from the outer perimeter surface of the midsole.

Clause 2: The sole structure of Clause 1, wherein the first plate portion extends from the outer perimeter surface at one of a medial side of the sole structure and a lateral side of the sole structure.

Clause 3: The sole structure of Clause 2, wherein the plate includes a second plate portion extending from the outer perimeter surface of the midsole.

Clause 4: The sole structure of Clause 3, wherein the second plate portion is disposed on an opposite side of the plate than the first plate portion.

Clause 5: The sole structure of Clause 3 or 4, wherein the second plate portion is disposed at the other of the medial side and the lateral side.

Clause 6: The sole structure of any of Clauses 3-5, wherein the first plate portion and the second plate portion are aligned with the MTP point.

Clause 7: The sole structure of any of Clauses 3-6, wherein the second plate portion is diametrically opposed to the first plate portion.

Clause 8: The sole structure of any of Clauses 1-7, wherein the first plate portion extends from a heel region of the sole structure.

Clause 9: The sole structure of any of Clauses 1-8, wherein the plate extends from an anterior end of the sole structure to a posterior end of the sole structure.

Clause 10: The sole structure of any of Clauses 1-9, wherein the plate includes a first plate segment disposed in a forefoot region of the sole structure and a second plate segment disposed in a heel region of the sole structure, the first plate segment spaced apart from the second plate segment.

Clause 11: The sole structure of any of Clauses 1-10, further comprising a bore extending through the midsole from a medial side of the sole structure to a lateral side of the sole structure.

Clause 12: The sole structure of Clause 11, wherein the bore is disposed at a heel region of the sole structure.

Clause 13: The sole structure of any of Clauses 1-12, wherein the first plate portion includes at least one of a flange, an aperture, and a slot operable to selectively attach the first plate portion to an external structure.

Clause 14: The sole structure of any of Clauses 1-13, wherein the midsole includes a first midsole portion disposed between the plate and the upper and a second midsole portion disposed between the plate and the outsole.

Clause 15: The sole structure of Clause 14, wherein the first midsole portion increases in thickness in a direction extending from a heel region of the sole structure toward a forefoot region of the sole structure.

Clause 16: The sole structure of Clause 14 or 15, wherein a thickness of the first midsole portion is greatest at the MTP point.

Clause 17: The sole structure of any of Clauses 14-16, wherein the second midsole portion increases in thickness in a direction extending from a forefoot region of the sole structure toward a heel region of the sole structure.

Clause 18: The sole structure of any of Clauses 1-17, wherein the first plate portion includes a main body extending from the outer perimeter surface of the midsole and a flange extending from the main body in a direction away from the outsole.

Clause 19: The sole structure of Clause 18, wherein the flange extends substantially perpendicular to the main body of the first plate portion.

Clause 20: An article of footwear incorporating the sole structure of any of Clauses 1-19

Clause 21: A sole structure for an article of footwear having an upper, the sole structure comprising an outsole having a ground-engaging surface and an upper surface formed on an opposite side of the outsole than the ground-engaging surface, a midsole attached to the outsole and including an outer perimeter surface extending between the outsole and the upper, and a plate disposed at least partially within the midsole and extending (i) from a forefoot region of the sole structure, (ii) through a metatarsophalangeal (MTP) point of the sole structure, and (iii) toward a heel region of the sole structure, the plate including a first plate portion defining a first hinge portion of a first hinge and a second plate portion defining a second hinge portion of a second hinge.

Clause 22: The sole structure of Clause 21, wherein the first plate portion extends from the outer perimeter surface at one of a medial side of the sole structure and a lateral side of the sole structure.

Clause 23: The sole structure of Clause 22, wherein the second plate portion extends from the outer perimeter surface at the other of the medial side of the sole structure and the lateral side of the sole structure.

Clause 24: The sole structure of Clause 23, wherein the second plate portion is disposed on an opposite side of the plate than the first plate portion.

Clause 25: The sole structure of Clause 23 or 24, wherein the second plate portion is disposed at the other of the medial side and the lateral side.

Clause 26: The sole structure of any of Clauses 21-25, wherein the first plate portion and the second plate portion are aligned with the MTP point.

Clause 27: The sole structure of any of Clauses 21-26, wherein the second plate portion is diametrically opposed to the first plate portion.

Clause 28: The sole structure of any of Clauses 21-27, wherein the first plate portion and the second plate portion extend along a longitudinal axis passing through the plate at a localized area of increased rigidity of the plate.

Clause 29: The sole structure of any of Clauses 21-28, wherein the plate extends from an anterior end of the sole structure to a posterior end of the sole structure.

Clause 30: The sole structure of any of Clauses 21-29, wherein the plate includes a first plate segment disposed in a forefoot region of the sole structure and a second plate segment disposed in a heel region of the sole structure, the first plate segment spaced apart from the second plate segment.

Clause 31: The sole structure of any of Clauses 21-30, further comprising a bore extending through the midsole from a medial side of the sole structure to a lateral side of the sole structure.

Clause 32: The sole structure of Clause 31, wherein the bore is disposed at a heel region of the sole structure.

Clause 33: The sole structure of any of Clauses 21-32, wherein the first hinge portion and the second hinge portion each includes at least one of a flange, an aperture, and a slot operable to selectively attach the first plate portion and the second plate portion to an external structure.

Clause 34: The sole structure of any of Clauses 21-33, wherein the midsole includes a first midsole portion disposed between the plate and the upper and a second midsole portion disposed between the plate and the outsole.

Clause 35: The sole structure of Clause 34, wherein the first midsole portion increases in thickness in a direction extending from a heel region of the sole structure toward a forefoot region of the sole structure.

Clause 36: The sole structure of Clause 34 or 35, wherein a thickness of the first midsole portion is greatest at the MTP point.

Clause 37: The sole structure of any of Clauses 34-36, wherein the second midsole portion increases in thickness in a direction extending from a forefoot region of the sole structure toward a heel region of the sole structure.

Clause 38: The sole structure of any of Clauses 21-37, wherein the first plate portion includes a first main body extending from the outer perimeter surface of the midsole and the first hinge portion includes a first flange extending from the first main body in a direction away from the outsole and the second plate portion includes a second main body extending from the outer perimeter surface of the midsole and the second hinge portion includes a second flange extending from the second main body in a direction away from the outsole.

Clause 39: The sole structure of Clause 38, wherein the first flange extends substantially perpendicular to the first main body of the first plate portion and the second flange extends substantially perpendicular to the second main body of the second plate portion.

Clause 40: An article of footwear incorporating the sole structure of any of Clauses 21-39.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear having an upper, the sole structure comprising:

an outsole having a ground-engaging surface and an upper surface formed on an opposite side of the outsole than the ground-engaging surface;

a midsole attached to the outsole and including an outer perimeter surface extending between the outsole and the upper, the midsole including an upper portion that includes a first thickness extending from an upper surface to a lower surface and a lower portion that includes a second thickness extending from an upper surface to a lower surface, the first thickness gradually decreases between a forefoot region and a heel region and the second thickness gradually increases between the forefoot region and the heel region; and a plate disposed between the upper portion and the lower portion of the midsole and extending (i) from the forefoot region of the sole structure, (ii) through a metatarsophalangeal (MTP) point of the sole structure, and (iii) toward the heel region of the sole structure, the plate including an upper surface that contacts the lower surface of the upper portion of the midsole, a lower surface that contacts the upper surface of the lower portion of the midsole, a curved portion in the forefoot region, and a substantially flat portion in the heel region, a first plate portion extending from the outer perimeter surface of the midsole.

2. The sole structure of claim 1, wherein the first plate portion extends from the outer perimeter surface at one of a medial side of the sole structure and a lateral side of the sole structure.

3. The sole structure of claim 2, wherein the plate includes a second plate portion extending from the outer perimeter surface of the midsole.

4. The sole structure of claim 3, wherein the second plate portion is disposed on an opposite side of the plate than the first plate portion.

5. The sole structure of claim 3, wherein the second plate portion is disposed at the other of the medial side and the lateral side.

6. The sole structure of claim 3, wherein the first plate portion and the second plate portion are aligned with the MTP point.

7. The sole structure of claim 3, wherein the second plate portion is diametrically opposed to the first plate portion.

8. The sole structure of claim 1, wherein the first plate portion extends from a heel region of the sole structure.

9. The sole structure of claim 1, wherein the first plate portion includes a main body extending from the outer perimeter surface of the midsole and a flange extending from the main body in a direction away from the outsole.

10. An article of footwear incorporating the sole structure of claim 1.

11. A sole structure for an article of footwear having an upper, the sole structure comprising:

an outsole having a ground-engaging surface and an upper surface formed on an opposite side of the outsole than the ground-engaging surface;

a midsole attached to the outsole and including an outer perimeter surface extending between the outsole and the upper, the midsole including an upper portion that includes a first thickness extending from an upper surface to a lower surface and a lower portion that includes a second thickness extending from an upper surface to a lower surface, the first thickness gradually decreases between a forefoot region and a heel region and the second thickness gradually increases between the forefoot region and the heel region; and a plate disposed between the upper portion and the lower portion of the midsole and extending (i) from the forefoot region of the sole structure, (ii) through a metatarsophalangeal (MTP) point of the sole structure, and (iii) toward the heel region of the sole structure, the plate including a curved portion in the forefoot region and a substantially flat portion in the heel region, and a first plate portion defining a first hinge portion and a second plate portion defining a second hinge portion.

12. The sole structure of claim 11, wherein the first plate portion extends from the outer perimeter surface at one of a medial side of the sole structure and a lateral side of the sole structure.

13. The sole structure of claim 12, wherein the second plate portion extends from the outer perimeter surface at the other of the medial side of the sole structure and the lateral side of the sole structure.

14. The sole structure of claim 13, wherein the second plate portion is disposed on an opposite side of the plate than the first plate portion.

15. The sole structure of claim 13, wherein the second plate portion is disposed at the other of the medial side and the lateral side.

16. The sole structure of claim 11, wherein the first plate portion and the second plate portion are aligned with the MTP point.

17. The sole structure of claim 11, wherein the second plate portion is diametrically opposed to the first plate portion.

18. The sole structure of claim 11, wherein the first plate portion and the second plate portion extend along a longitudinal axis passing through the plate at a localized area of increased rigidity of the plate.

19. The sole structure of claim 11, wherein the first plate portion includes a first main body extending from the outer perimeter surface of the midsole and the first hinge portion includes a first flange extending from the first main body in a direction away from the outsole and the second plate portion includes a second main body extending from the outer perimeter surface of the midsole and the second hinge portion includes a second flange extending from the second main body in a direction away from the outsole.

20. An article of footwear incorporating the sole structure of claim 11.

* * * * *